US007547226B2

(12) United States Patent
Koessler

(10) Patent No.: US 7,547,226 B2
(45) Date of Patent: Jun. 16, 2009

(54) WIRE CONNECTORS FOR SURGE PROTECTORS AND OTHER ELECTRICAL COMPONENTS

(76) Inventor: Juergen Koessler, 3262—164th Street, Surrey, BC (CA) V3S 0G5

( * ) Notice: Subject to any disclaimer, the term of this patent is extended or adjusted under 35 U.S.C. 154(b) by 3 days.

(21) Appl. No.: 11/678,031

(22) Filed: Feb. 22, 2007

(65) Prior Publication Data

US 2008/0207041 A1 Aug. 28, 2008

(51) Int. Cl.
*H01R 11/20* (2006.01)

(52) U.S. Cl. ..... 439/409

(58) Field of Classification Search ..... 439/404–417, 439/482, 912

See application file for complete search history.

(56) References Cited

U.S. PATENT DOCUMENTS

| | | | | |
|---|---|---|---|---|
| 4,834,669 | A | 5/1989 | Siemon et al. | |
| 5,273,449 | A | 12/1993 | Mattis et al. | |
| 5,449,299 | A | 9/1995 | Shimirak et al. | |
| 5,785,548 | A | 7/1998 | Capper et al. | |
| 6,015,312 | A * | 1/2000 | Escane | 439/417 |
| 6,152,760 | A | 11/2000 | Reeser | |
| 6,188,560 | B1 * | 2/2001 | Waas | 361/119 |
| 6,222,717 | B1 * | 4/2001 | Waas et al. | 361/119 |
| 6,246,749 | B1 | 6/2001 | Garver et al. | |
| 6,293,815 | B1 * | 9/2001 | Daoud | 439/426 |
| 6,312,282 | B1 | 11/2001 | Blaha et al. | |
| 6,406,324 | B1 | 6/2002 | Duesterhoeft et al. | |
| 6,416,352 | B1 * | 7/2002 | Dooley | 439/482 |
| 6,457,990 | B1 | 10/2002 | Daoud | |
| 6,500,020 | B2 | 12/2002 | Vo et al. | |
| 7,014,496 | B2 | 3/2006 | Shimirak | |
| 2002/0061675 | A1 * | 5/2002 | Borst | 439/404 |
| 2002/0155745 | A1 | 10/2002 | Vo et al. | |
| 2005/0272298 | A1 | 12/2005 | Miyoshi | |
| 2006/0057884 | A1 | 3/2006 | Fasce et al. | |
| 2006/0089040 | A1 | 4/2006 | Pratt | |

* cited by examiner

*Primary Examiner*—Renee Luebke
*Assistant Examiner*—Larisa Tsukerman
(74) *Attorney, Agent, or Firm*—Oyen Wiggs Green & Mutala LLP

(57) ABSTRACT

A wire-connection apparatus for connecting wire to an electrical component having a terminal comprising a pair of contact members having a pair of adjacent edges is disclosed. The wire-connection apparatus comprises a wire-holding member connected for pivotal motion with respect to the terminal. The wire-holding member is penetrated by a wire-holding conduit for receiving a corresponding wire and is pivotal to a connection configuration wherein the corresponding wire extends through a space between the adjacent edges of the contact members to make electrical contact with the terminal. The wire-connection apparatus comprises a probe-access cover connected for pivotal motion with respect to the wire-holding member. The probe-access cover is pivotal to an open configuration, such that when the probe-access cover is in its open configuration and the wire-holding member is in its connection configuration, the cover portion is spaced apart from the face for exposing at least a portion of the terminal to contact by an electrical probe.

36 Claims, 19 Drawing Sheets

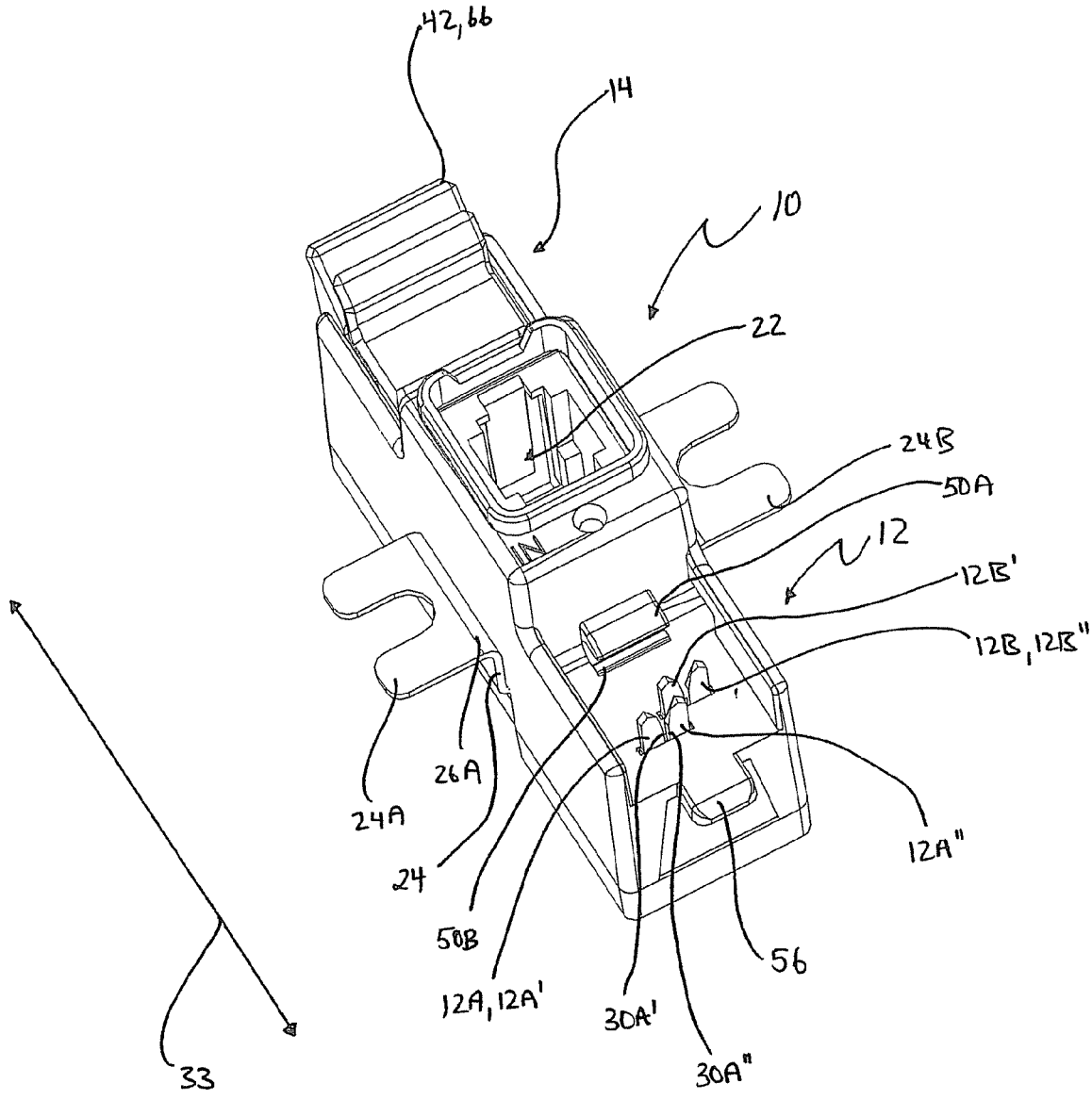
FIGURE 8
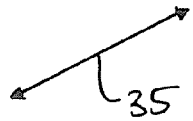

WIRE CONNECTORS FOR SURGE PROTECTORS AND OTHER ELECTRICAL COMPONENTS

TECHNICAL FIELD

The invention disclosed herein relates to connecting wires to electrical components. Particular embodiments of the invention provide apparatus for surge protectors used in the telecom industry and for connecting wires thereto.

BACKGROUND

Connecting wires to electrical components can be time consuming. Traditional wire-connection terminals comprise metallic threaded members which pinch the wire to maintain electrical contact between the conductive portion of the wire and the conductive parts of the terminal. Electrically connecting a wire to an electric component using such wire-connection apparatus typically involves stripping the insulation from the wire, bending the exposed conductive wire around a threaded post and threading a nut over the post to pinch the wire against a conductive substrate.

There is a general desire to provide electrical components with wire-connection apparatus which make it easier and faster to electrically connect wire(s) to the components.

Once wires are connected to the terminals of electrical components, it is often desirable to be able to test the electrical connections. By way of non-limiting example, it is often useful to test to confirm the electrical connection, to observe the signal on the electrical terminal and/or to troubleshoot the operation of the corresponding electrical component. Typically, such testing involves making electrical contact between the wire-connection terminals of an electrical component and the probes of an electrical measurement and/or diagnostic device (e.g. a multimeter, oscilloscope, network analyzer or the like).

BRIEF DESCRIPTION OF THE DRAWINGS

In drawings which depict non-limiting embodiments of the invention:

FIG. 8 is a partial isometric view of the FIG. 1 surge protector with one of its wire-holding members and one of its probe-access covers removed;

DETAILED DESCRIPTION

Throughout the following description, specific details are set forth in order to provide a more thorough understanding of the invention. However, the invention may be practised without these particulars. In other instances, well known elements have not been shown or described in detail to avoid unnecessarily obscuring the invention. Accordingly, the specification and drawings are to be regarded in an illustrative, rather than a restrictive, sense.

Particular embodiments of the invention provide wire-connection apparatus for connecting wires (e.g. telecom wires) to electrical components (e.g. telecom components). The wire-connection apparatus comprises a wire-holding member having a wire-holding conduit and a passage intersecting the wire-holding conduit. The wire-holding member is pivotal to a connection configuration wherein a terminal of the electrical component is received in the passage and a wire received in the wire holding conduit makes electrical contact with the terminal. The wire-connection apparatus also comprises a movable connected probe-access cover. The probe-access cover is movable with respect to the wire-holding member to: a closed configuration, wherein the probe-access cover protects the terminal from contact; and an open configuration, wherein the probe-access cover is spaced apart from the terminal for exposing at least a portion of the terminal to contact by an electrical probe.

FIGS. 1-13 show various views of an electrical component 10 which incorporates a pair of wire-connection apparatus 12, 14 according to a particular embodiment of the invention. Electrical component 10 shown in the illustrated embodiment is a surge protector of the type which may be used in the telecom industry. However, the illustrated surge protector represents only one type of electrical component 10. The wire-connection apparatus 12, 14 described herein may generally be used with a wide variety of electrical components 10 and are not limited to use with surge protectors. References to electrical component 10 in this description should be understood to include other types of electrical components. By way of non-limiting example, such electrical components 10 may include wire terminal connectors, signal-splitting connector arrays and the like.

Figure 7:
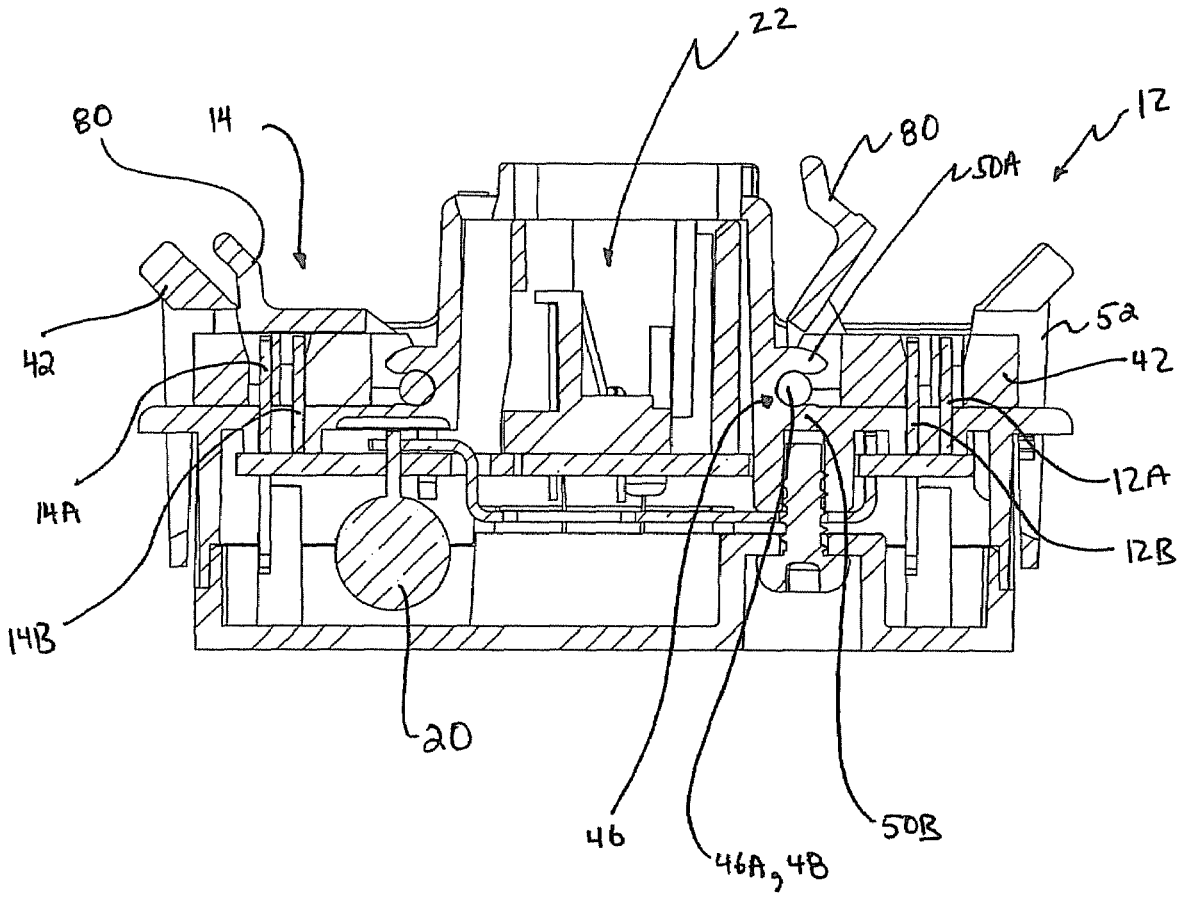
FIG. 7 is a cross-sectional view showing one of the wire-connection apparatus of the FIG. 1 surge protector with its wire-holding member pivoted to its connection configuration and the probe-access cover in its open configuration.

In the illustrated embodiment, wire-connection apparatus 12 comprises a pair of electrical terminals 12A, 12B capable of providing separate electrical contact for a corresponding pair of wires 16A, 16B (collectively, wires 16) and wire-connection apparatus 14 comprises a pair of electrical terminals 14A, 14B capable of providing separate electrical contact for a corresponding pair of wires 18A, 18B (collectively, wires 18). Wires 16 are shown in FIG. 7. Wires 18 are not specifically shown in the illustrated views. Wires 18 may be similar to wires 16 and may connect terminals 14A, 14B of wire-connection apparatus 14 in the same manner that wires 16 connect to terminals 12A, 12B of wire-connection apparatus 12 (described below). In other embodiments, wire-connection apparatus according to the invention may be adapted to provide any suitable number of electrical terminals and to be capable of providing electrical contact for a corresponding number of wires.

Figure 3:
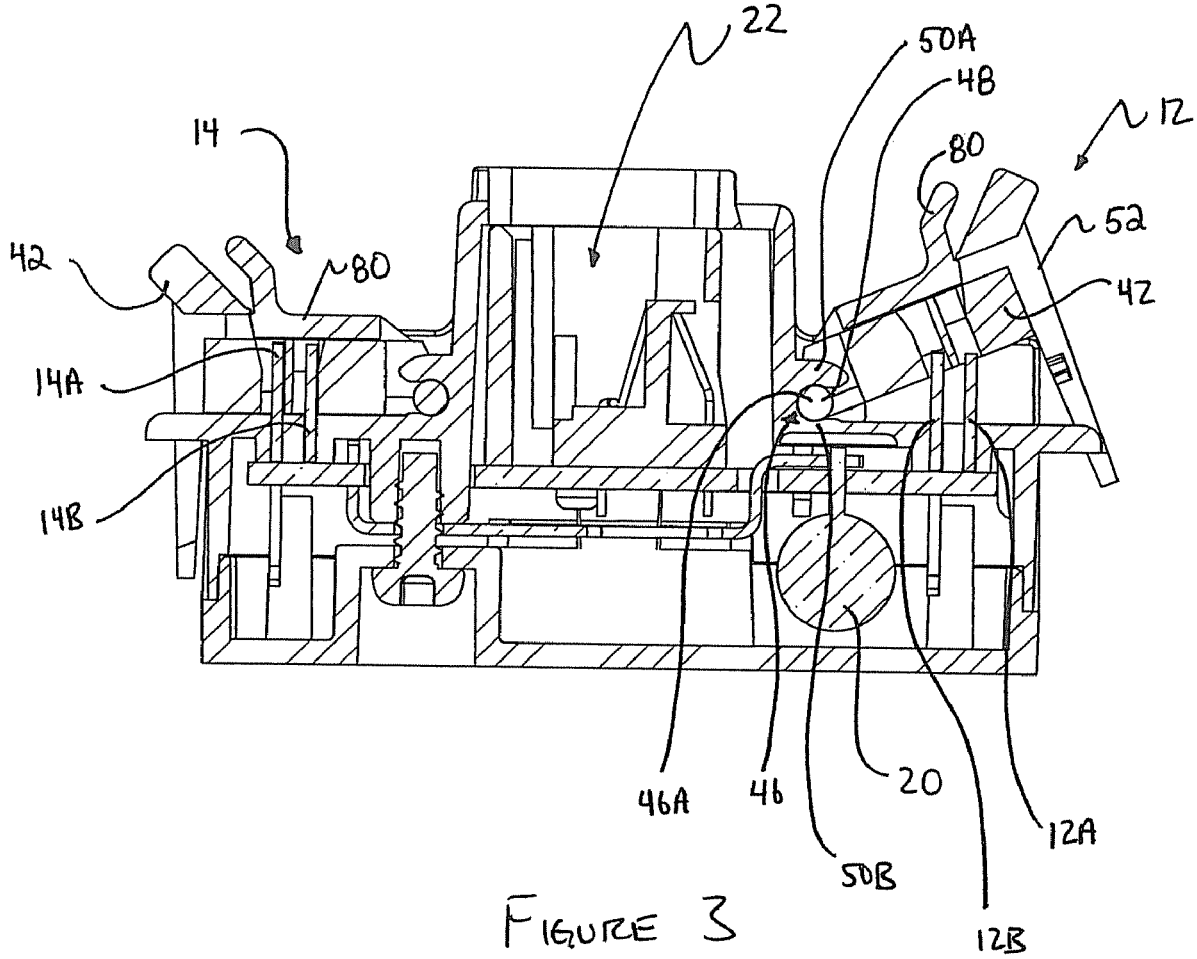
FIG. 3 is a cross-sectional view of the FIG. 1 surge protector taken though the vertical axis of FIG. 2.
Figure 4:
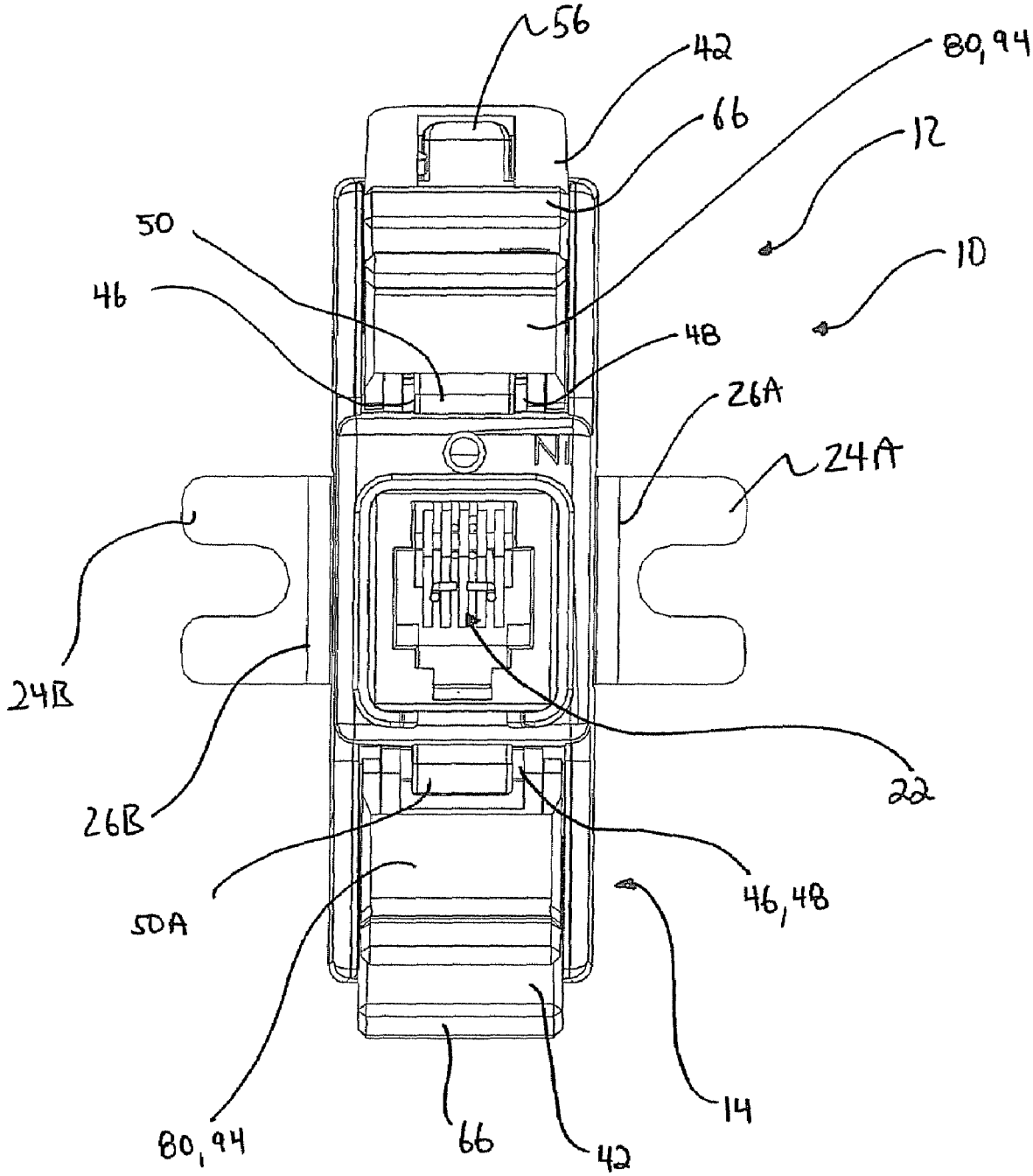
FIG. 4 is a top plan view of the FIG. 1 surge protector.

The illustrated electrical component 10 (i.e. a surge protector) may be used in the telecommunications industry, for example. The illustrated surge protector protects other electrical devices (e.g. telecommunications equipment) connected to telecommunications jack 22 from power surges and voltage spikes on wires 16, 18, such as those caused by lightning strikes, for example. In the illustrated electrical component 10, this surge protection function is provided by gas arrestor 20 (FIG. 3). Gas arrestor 20 comprises a gas discharge tube which is configured such that voltage greater than its "clamping voltage" causes the gas in the tube to ionize and to thereby allow surge current to short to ground plane 24 bypassing jack 22 and any electrical devices connected thereto.

In the illustrated embodiment, ground plane 24 comprises a pair of conductive grounding brackets 24A, 24B each of which may be used to connect electrical component 10 to a junction box or the like. Grounding brackets 24A, 24B may be provided with "break-away" notches 26A, 26B or the like, which allow users to break brackets 24A, 24B from ground plane 24 in circumstances where it is desired to fit electrical component 10 into a tight location.

Wire-connection apparatus 14 is substantially similar to wire-connection apparatus 12. Consequently, the description presented below focuses on wire-connection apparatus 12, it being understood that wire-connection apparatus 14 comprises similar features to those of wire-connection apparatus 12. Other than for terminals 14A, 14B, the components of wire-connection apparatus 14 are provided with similar reference numerals to those of wire-connection apparatus 12. In the illustrated views, some of the components of wire-connection apparatus 12 can be seen in different configurations and from different vantage points by observing corresponding components of apparatus 14.

Wire-connection apparatus 12 comprises a pair of electrical terminals 12A, 12B which provide separate electrical contacts for wires 16A, 16B. Terminal 12A comprises a pair of conductive contact members 12A', 12A". Preferably, contact members 12A', 12A" respectively comprise adjacent edges 30A', 30A". Preferably, adjacent edges 30A', 30A" are co-planar as shown in FIG. 8. In the illustrated embodiment, adjacent edges 30A', 30A" respectively comprise contact portions 32A', 32A" which are spaced apart from one another by a distance which is slightly less than the thickness of the conductive core of wire 16A. In addition, adjacent edges 30A', 30A" may also respectively comprise wire-receiving portions 34A', 34A" which are spaced apart from one another by a distance greater than the distance between contact portions 32A', 32A". In the illustrated embodiment, wire receiving portions 34A', 34A" are shaped on angles with respect to contact portions 32A', 32A", such that the spacing between wire receiving portions 34A', 34A" increases as wire receiving portions 34A', 34A" extend away from contact portions 32A', 32A". That is, the gap (not specifically enumerated) between wire receiving portions 34A', 34A" tapers to guide wires into the space between contact portions 32A', 32A" (discussed in more detail below).

Other than its location in electrical component 10, terminal 12B is substantially similar to terminal 12A and incorporates contact members 12B', 12B" having similar edge features. The location of terminal 12B is shown in FIG. 8, where it can be seen that terminal 12B is spaced apart from terminal 12A along the longitudinal dimension of electrical component 10 (shown by double-headed arrow 33), such that terminal 12B is located closer to jack 22 than terminal 12A. The location of terminal 12B is also offset from the location of terminal 12A along the transverse dimension of electrical component 10 (shown by double headed arrow 35).

Wire-connection apparatus 12 also comprises a non-conductive wire-holding member 42. Preferably, wire-holding member 42 is fabricated from a material that is rigid, but is moderately elastically deformable, such as plastic for example. Suitable plastics include, without limitation, ABS and polycarbonate. In the illustrated embodiment, wire-holding member 42 incorporates a pair of wire-holding conduits 44A, 44B for respectively receiving and holding wires 16A, 16B.

Figure 9:
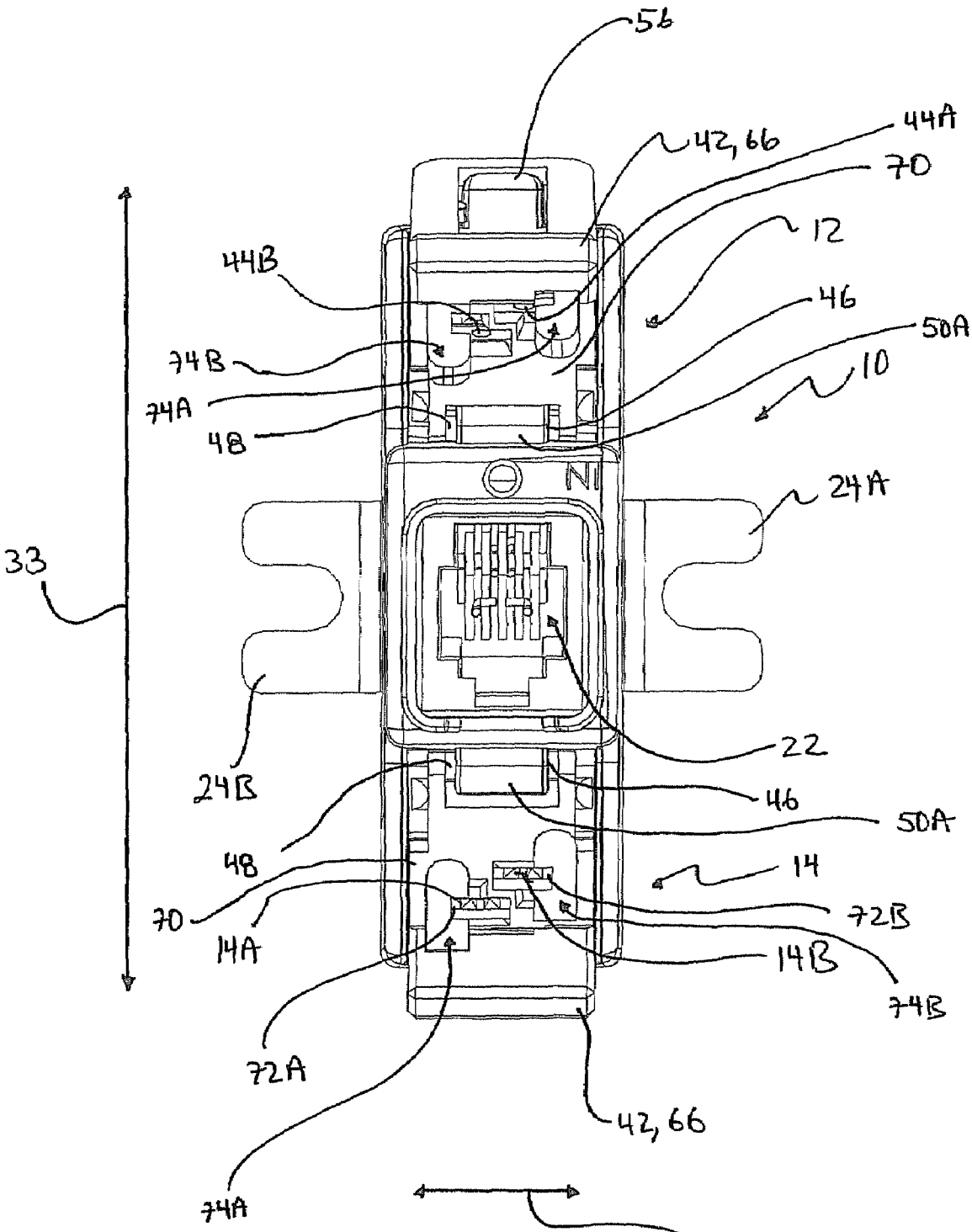
FIG. 9 is a top view of the FIG. 1 surge protector with its probe-access covers removed.
Figure 10:
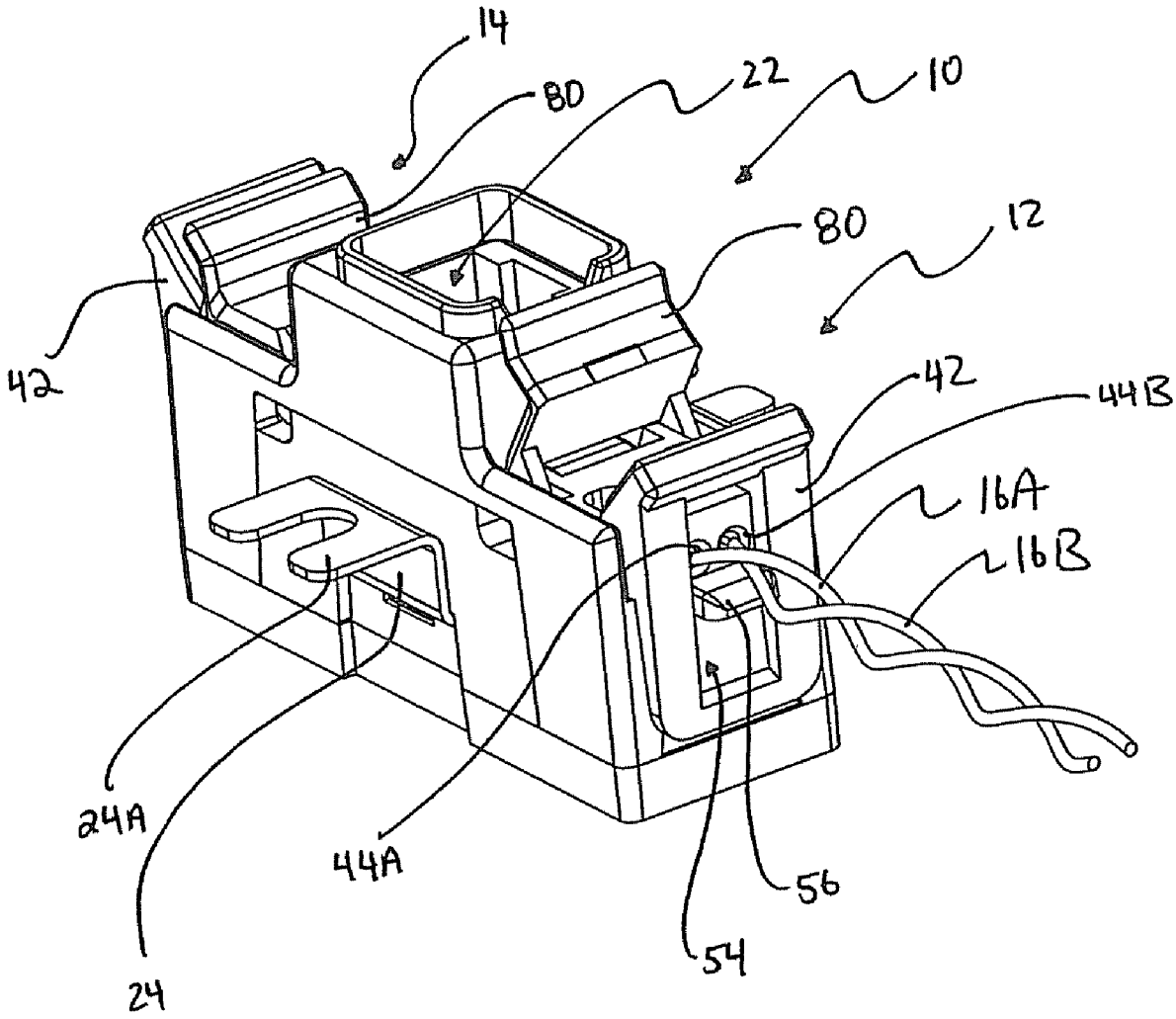
FIG. 10 is an isometric view of the FIG. 1 surge protector with wires held in its corresponding wire-holding members.

Wire-holding member 42 is pivotally connected to electrical component 10 at pivot joint 46 which allows wire-holding member 42 to pivot with respect to electrical component 10 about a pivot axis 46A that extends in the transverse direction (i.e. in the direction of arrow 33 of FIGS. 8 and 9). In the illustrated embodiment, pivot joint 46 is implemented by a hinge pin 48 on wire-holding member 42 which is received between a pair of pin holders 50A, 50B (collectively, pin holders 50) on electrical component 10. Preferably, hinge pin 48 and pin holders 50 are coupled to one another by a deformable "snap-together" fitting, wherein pin holders 50 may be deformed to receive hinge pin 48, thereby coupling wire-holding member 42 to electrical component 10 and wherein pin holders 50 may be deformed to remove hinge pin 48, thereby decoupling wire-holding member 42 from electrical component 10. It will be appreciated that pivot joint 46 may be implemented using a wide variety of techniques and the invention should be understood to incorporate any suitable mechanism for implementing pivot joint 46 between wire-holding member 42 and electrical component 10.

In the illustrated embodiment, wire-holding member 42 comprises a transversely extending face 52 having an aperture 54 therethrough and electrical component 10 comprises a longitudinally extending projection 56 that extends from one side of face 52 (i.e. the side of face 52 more proximate to jack 22) and into aperture 54. In the illustrated embodiment, aperture 54 is generally rectangular in shape (although its corners have some radius) and is defined by opposing parallel edges 58A, 58B and opposing parallel edges 58C, 58D.

Contact between projection 56 and edge 58D limits the pivotal motion of wire-holding member 42 with respect to electrical component 10 (for one of the angular directions of pivot joint 46). When pivot joint 46 is configured such that projection 56 contacts edge 58D, wire-holding member 42 is said to be in its "wire insertion/removal configuration". Wire-holding member 42 of wire-connection apparatus 12 is shown in its wire insertion/removal configuration in FIGS. 1, 2A and 3.

Figure 1:
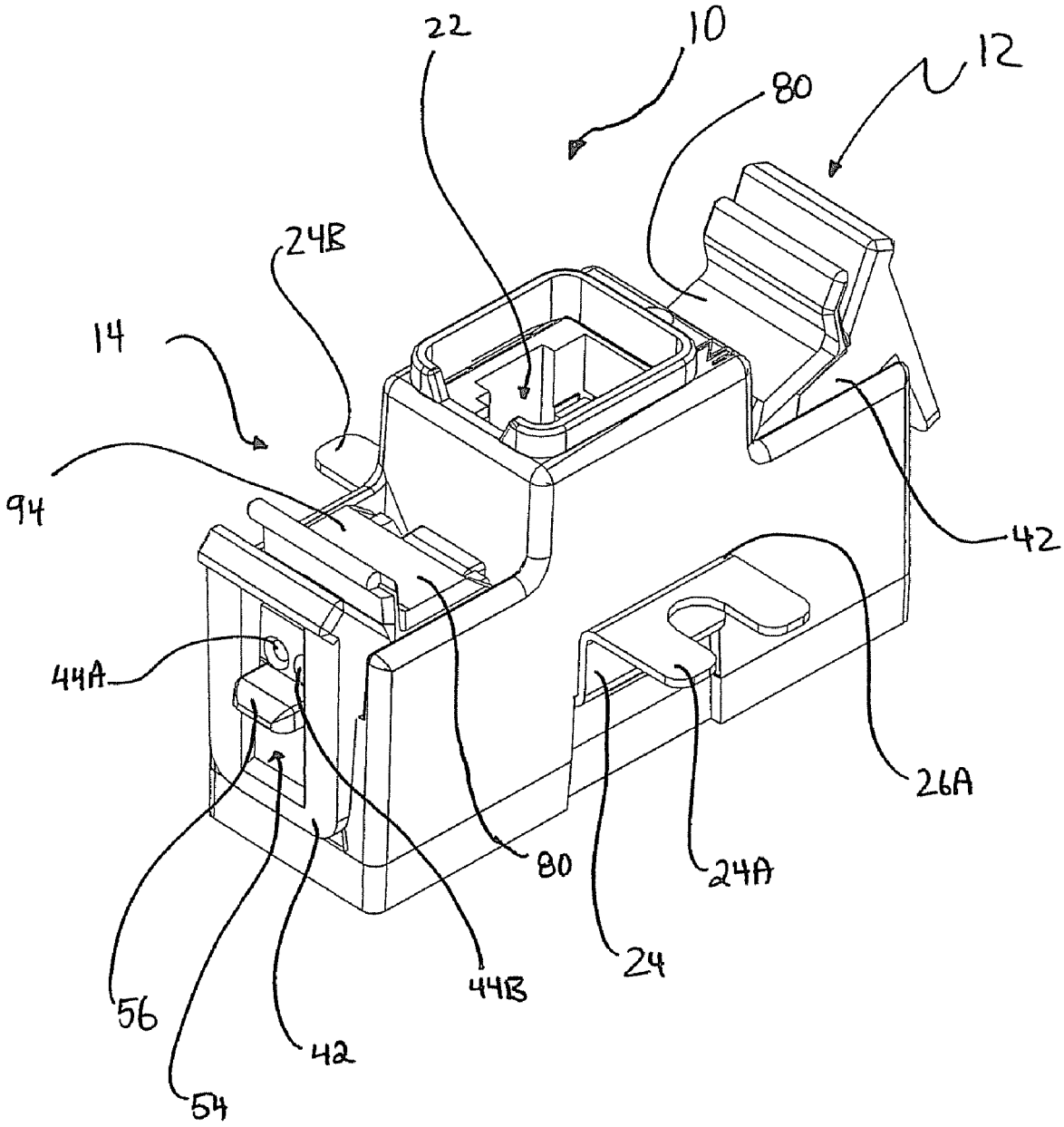
FIG. 1 is an isometric view of a surge protector according to a particular embodiment of the invention with one of its wire-holding members pivoted to its connection configuration and the second one of its wire-holding members pivoted to its wire insertion/removal configuration.
Figure 2A:
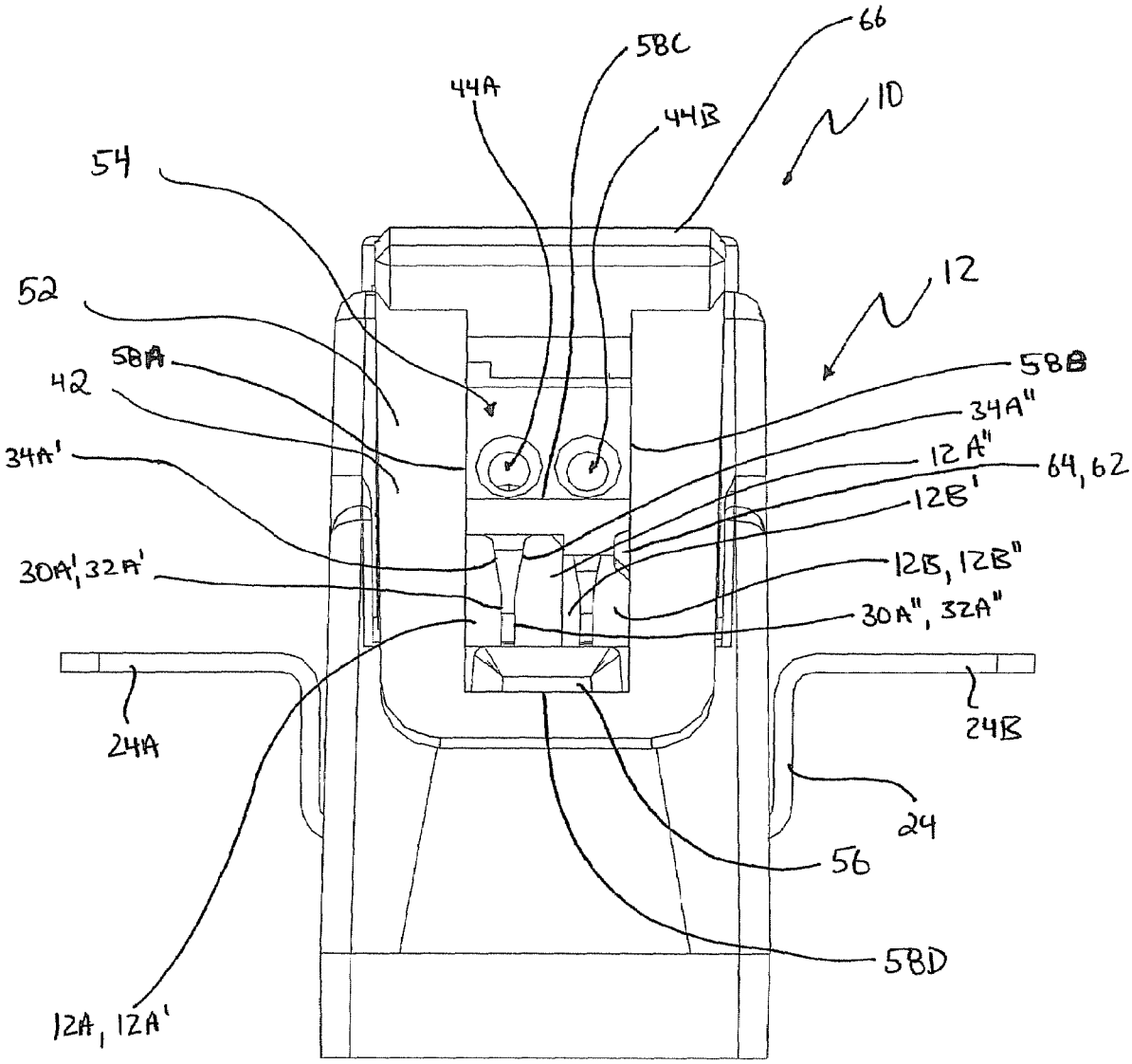
FIG. 2A is a plan view of one of the ends of the FIG. 1 surge protector.
Figure 2B:
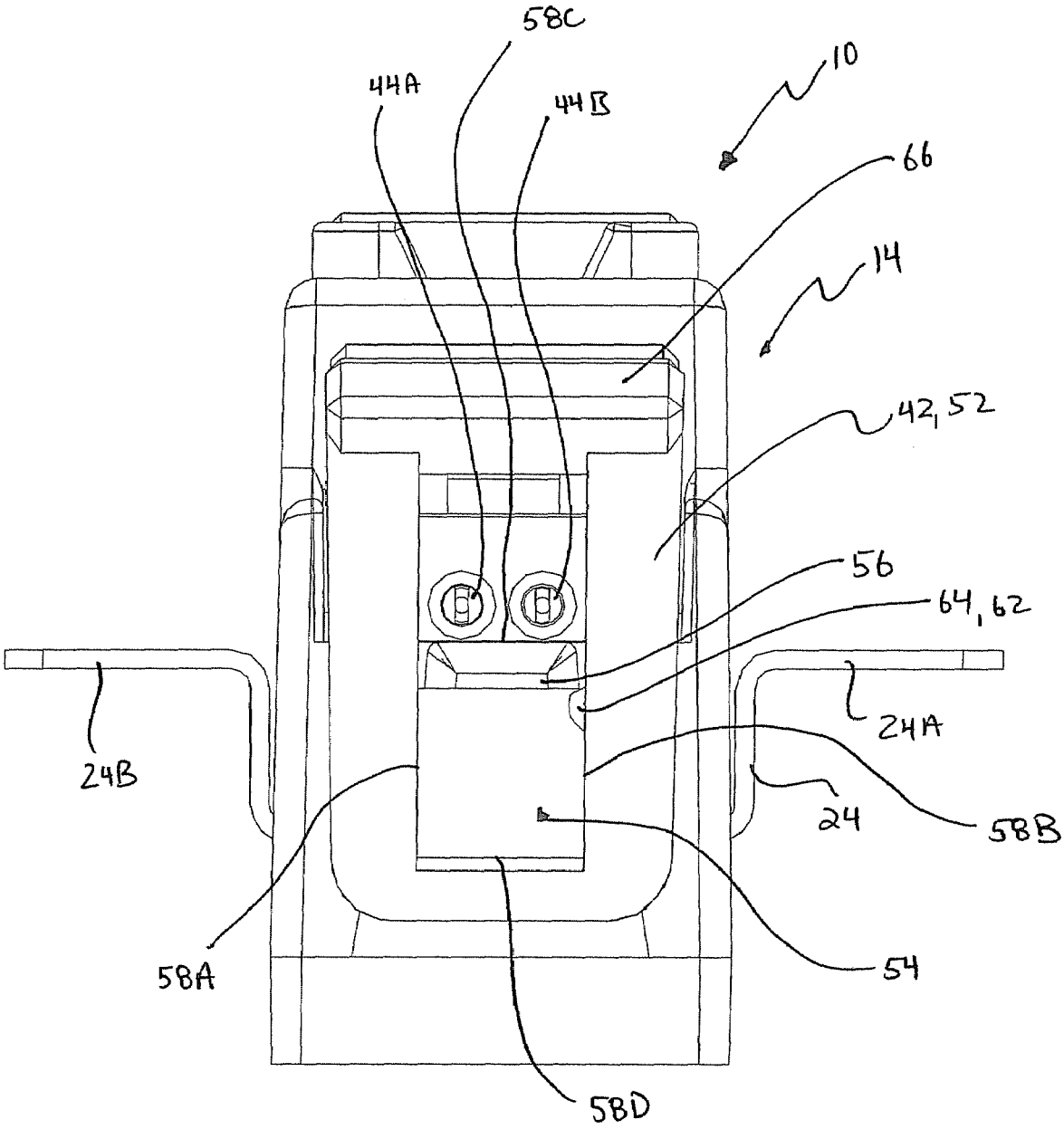
FIG. 2B is a plan view of the opposing end of the FIG. 1 surge protector.

Contact between projection 56 and edge 58C of aperture 54 limits the pivotal motion of wire-holding member 42 with respect to electrical component 10 (for the opposing angular direction of pivot joint 46). When pivot joint 46 is configured such that projection 56 contacts edge 58C, wire-holding member 42 is said to be in its "connection configuration". In the illustrated views, wire-holding member 42 of wire-connection apparatus 12 is shown only in its wire insertion/removal configuration. However, FIGS. 1, 2B and 3 show wire-holding member 42 of wire-connection apparatus 14 in its connection configuration. The connection configuration of wire-connection apparatus 12 is substantially similar to the connection configuration of wire-connection apparatus 14.

Wire-connection apparatus 12 may comprise a locking mechanism 62 for maintaining wire-holding member 42 in its connection configuration. In the illustrated embodiment, locking mechanism 62 comprises a protrusion 64 on edge 58B of aperture 54. In the vicinity of protrusion 64, the transverse dimension (see arrow 35 of FIGS. 8 and 9) of aperture 54 is less than the transverse dimension of projection 56. Accordingly, pivoting wire-holding member 42 (at pivot joint 46) such that projection 56 moves from one side of protrusion 64 to the opposing side of protrusion 64 requires deformation of projection 56 and/or wire-holding member 42. Preferably, the force required to effect this deformation is an amount of force that is relatively easily imparted by a human user when the user is specifically trying to pivot wire-holding member 42, but is greater than an amount of force that might be implemented by random incidental contact or the like. As shown best in FIG. 3, wire-holding member 42 may comprise a tab 66 that extends at an angle from face 52 to give users a surface to apply such force with their fingers or thumbs or with a suitable tool.

The location of protrusion 64 on edge 58B is preferably spaced apart from edge 58C by a distance approximately equal to the thickness of projection 56 (FIG. 2B). Accordingly, when wire-holding member 42 is in its connection configuration (i.e. with projection 56 contacting edge 58C of aperture 54 as shown in FIG. 2B), projection 56 contacts (or is immediately adjacent to) protrusion 64. Protrusion 64 therefore acts to lock wire-holding member 42 in its connection configuration as deformation is required in order to pivot wire-holding member out of its connection configuration. Locking mechanism 62, which requires deformation of one or more of its components (e.g. projection 56 and/or wire-holding member 42) to lock and/or unlock its components, may be referred to as a deformation-type "snap lock" mechanism. It will be appreciated that locking mechanism 62 may be implemented using locking mechanisms other than a snap lock mechanism. The invention should be understood to include such alternative locking mechanisms.

Figure 11A:
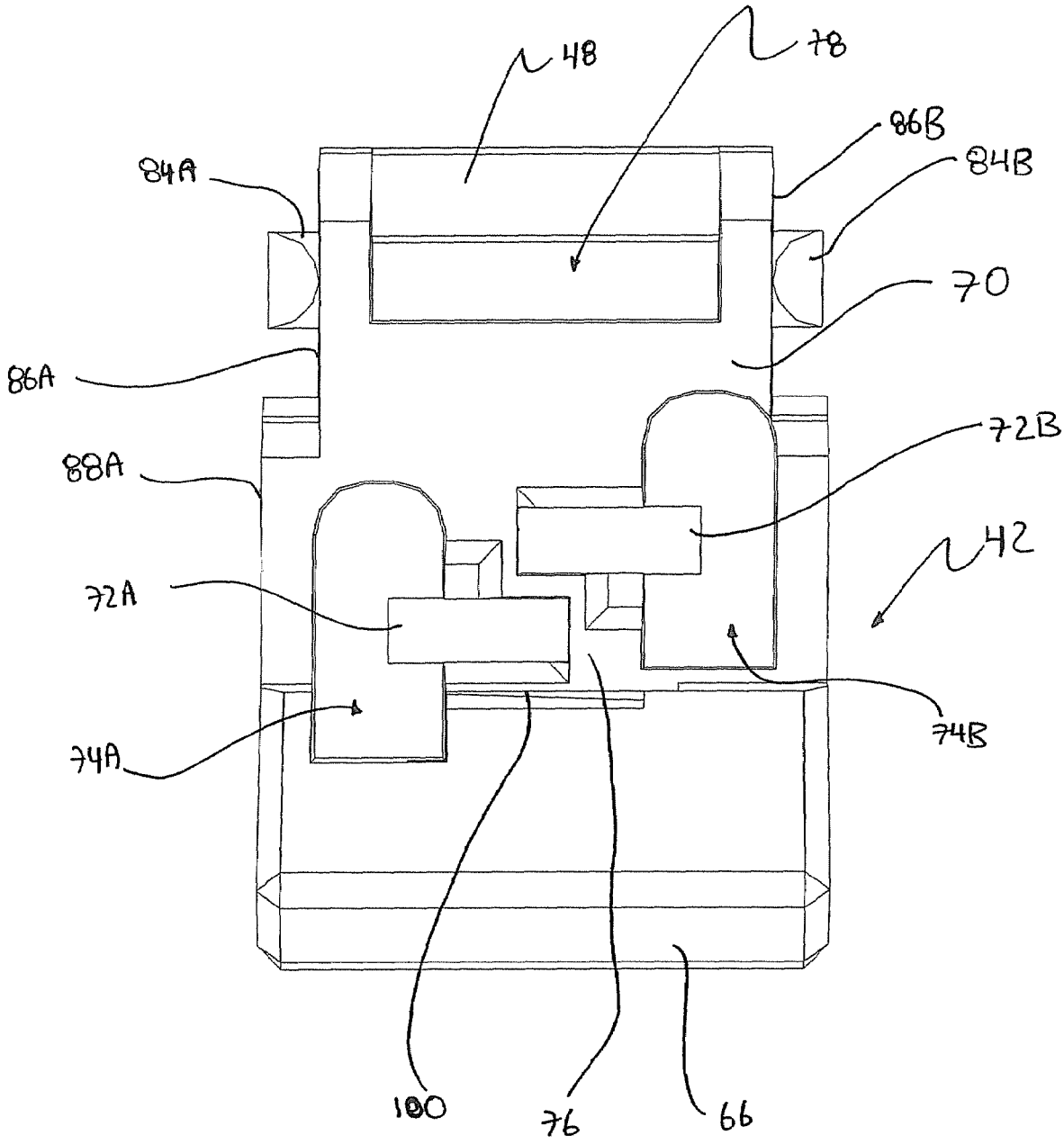
FIGS. 11A-11D are respectively top, bottom, side and end plan views of one of the wire-holding members of the FIG. 1 surge protector.
Figure 11B:
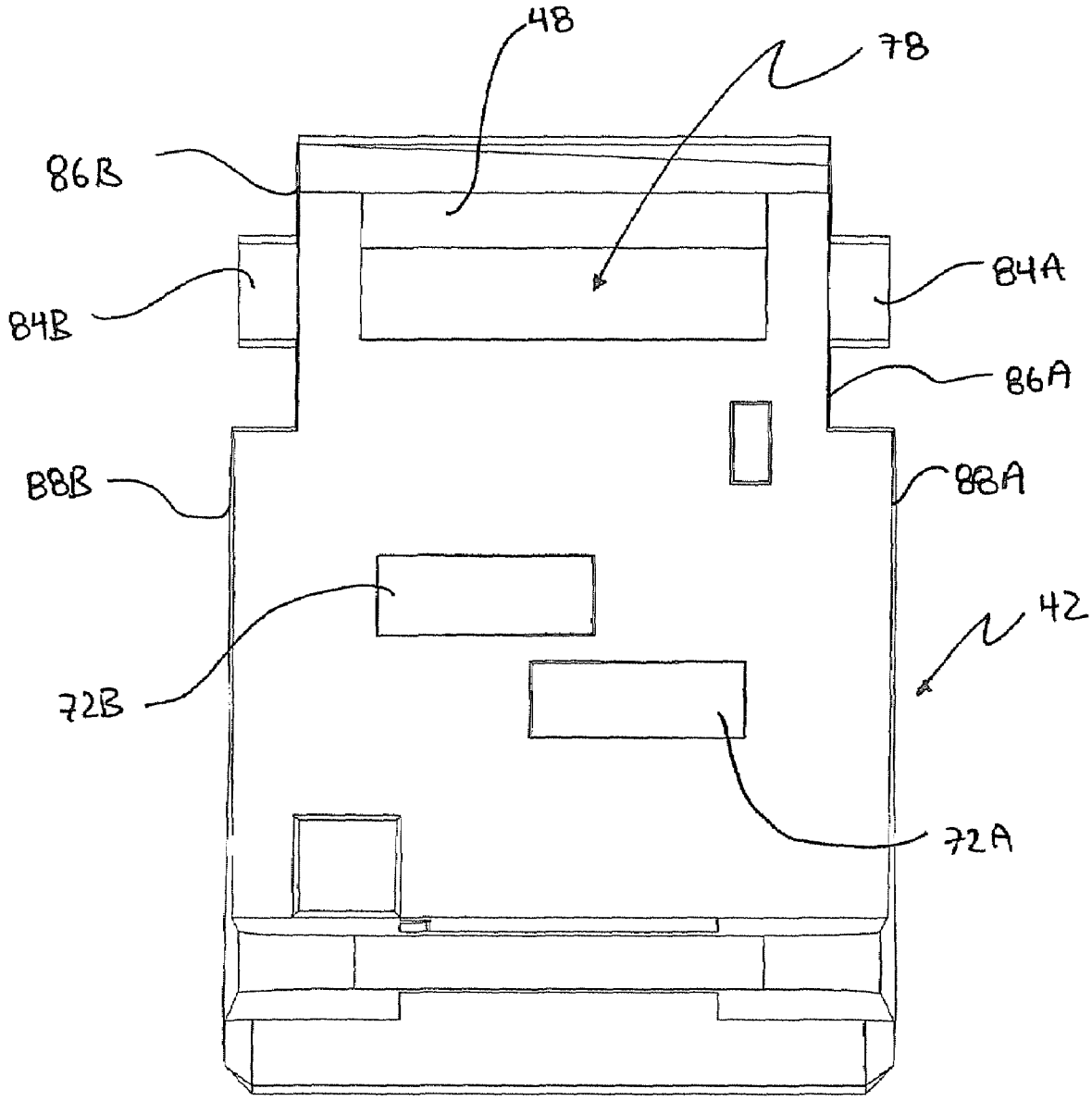
Figure 11C:
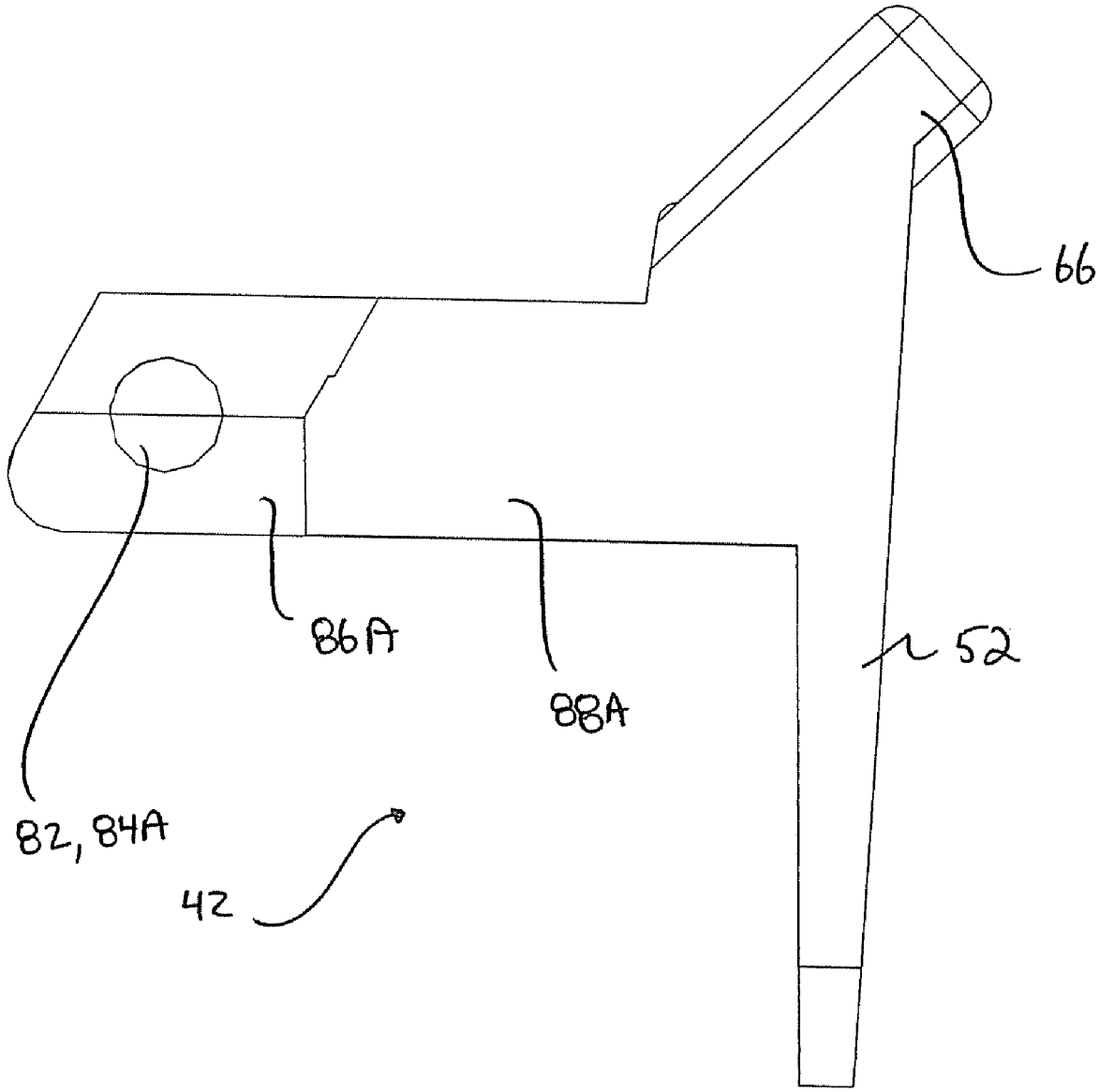
Figure 11D:
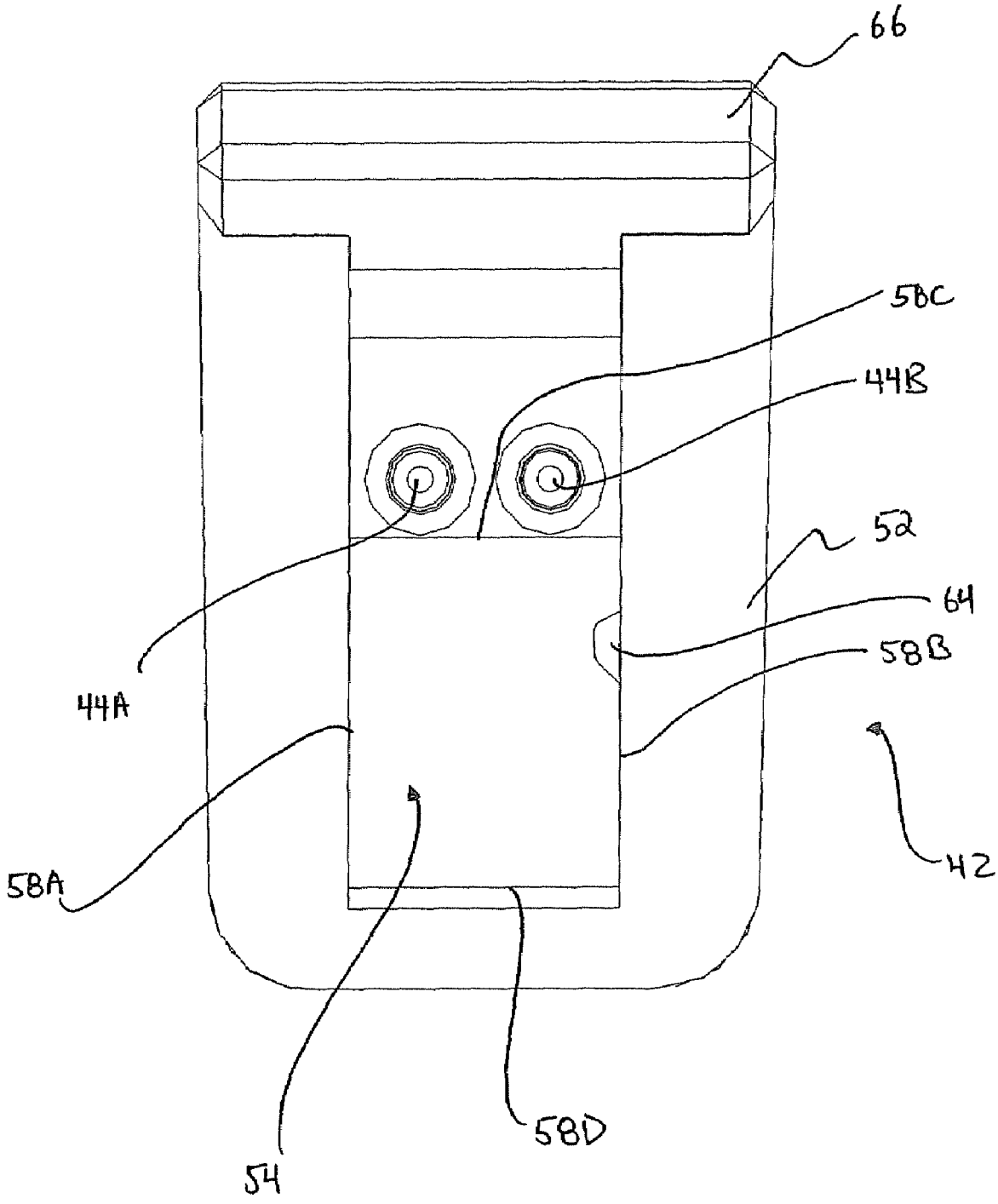
Figure 11E:
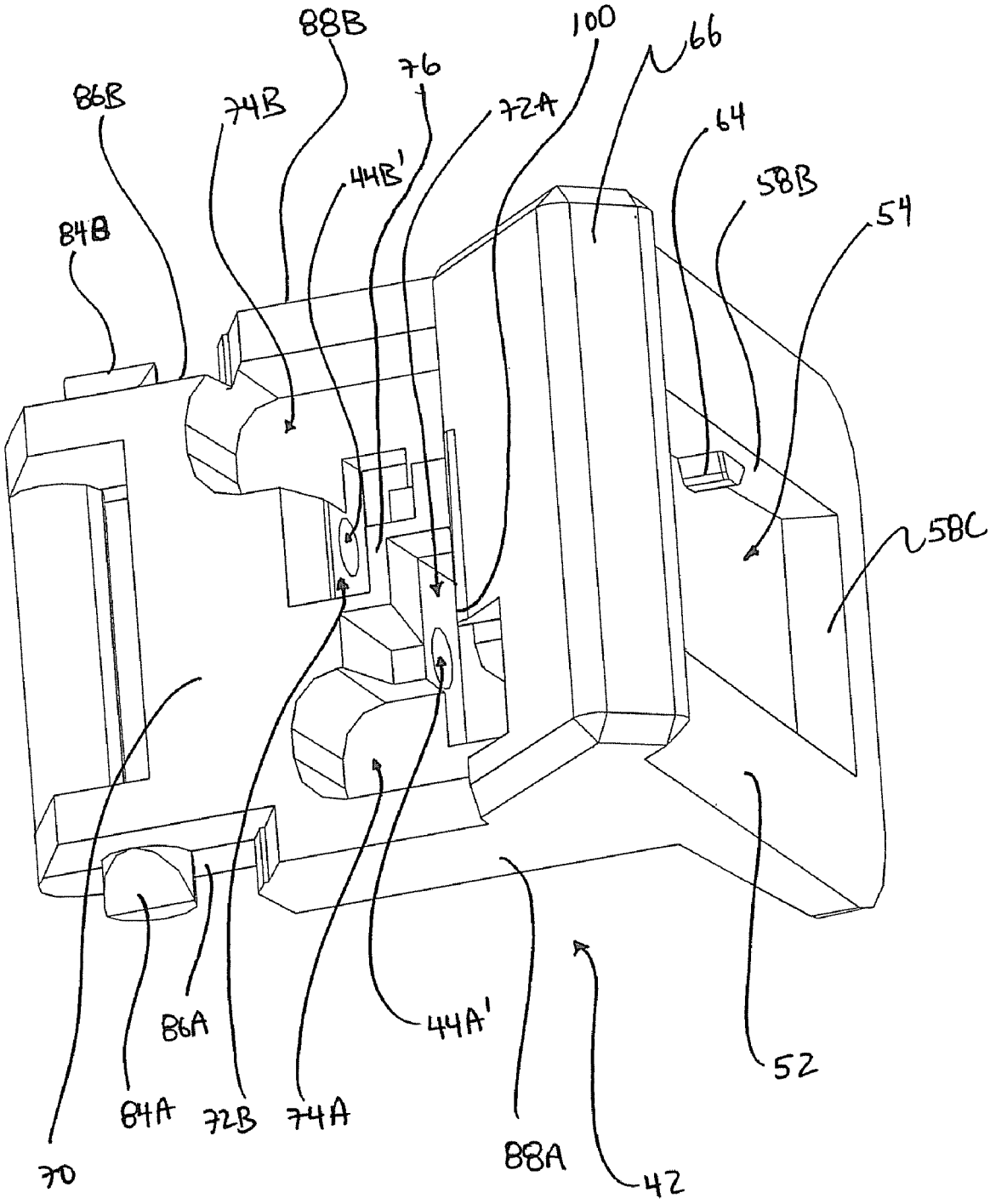
FIG. 11E is an isometric view of one of the wire-holding members of the FIG. 1 surge protector.
Figure 12A:
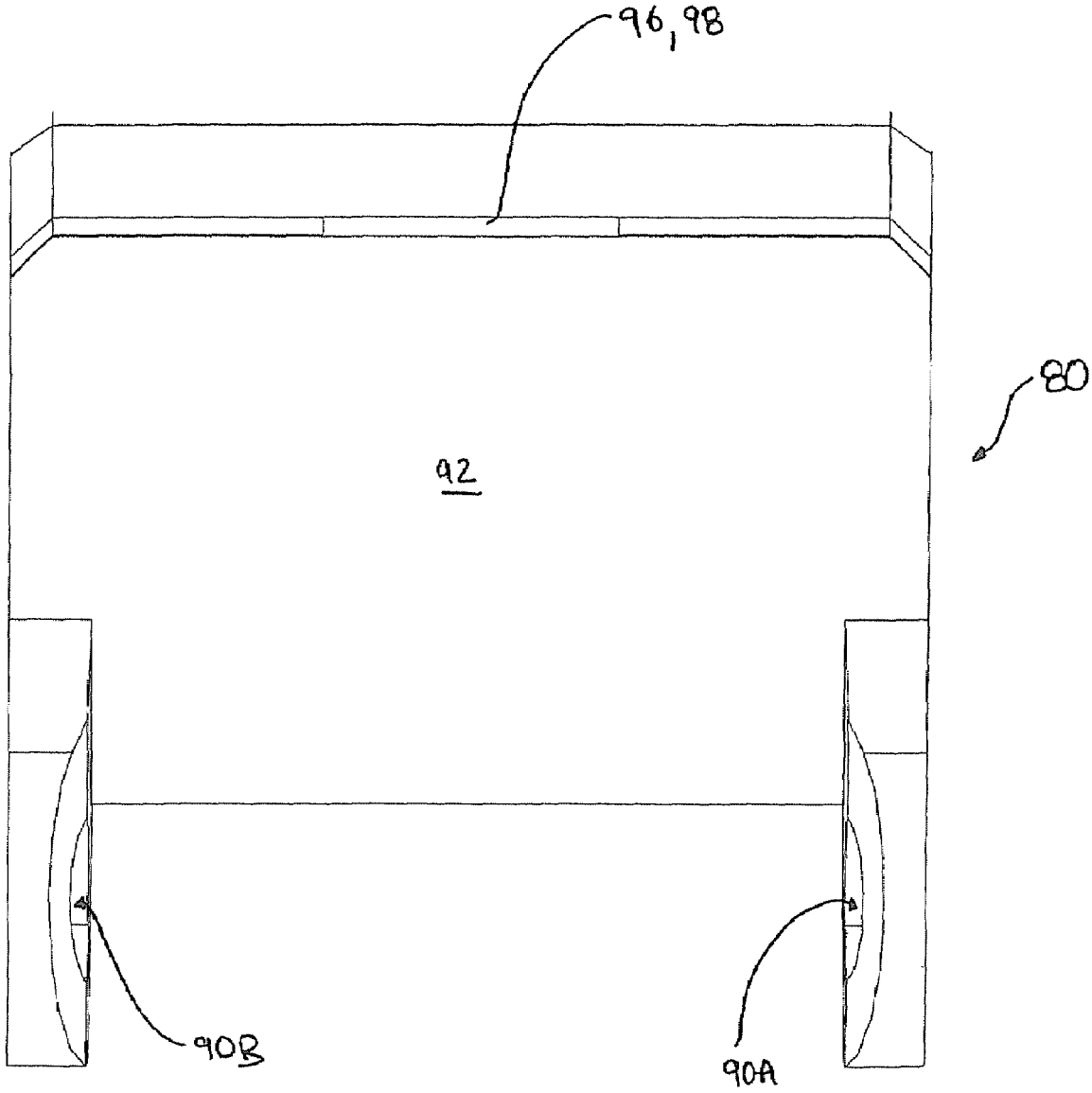
FIGS. 12A-12B are respectively bottom and side plan views of a probe-access cover of the FIG. 1 surge protector.
Figure 12B:
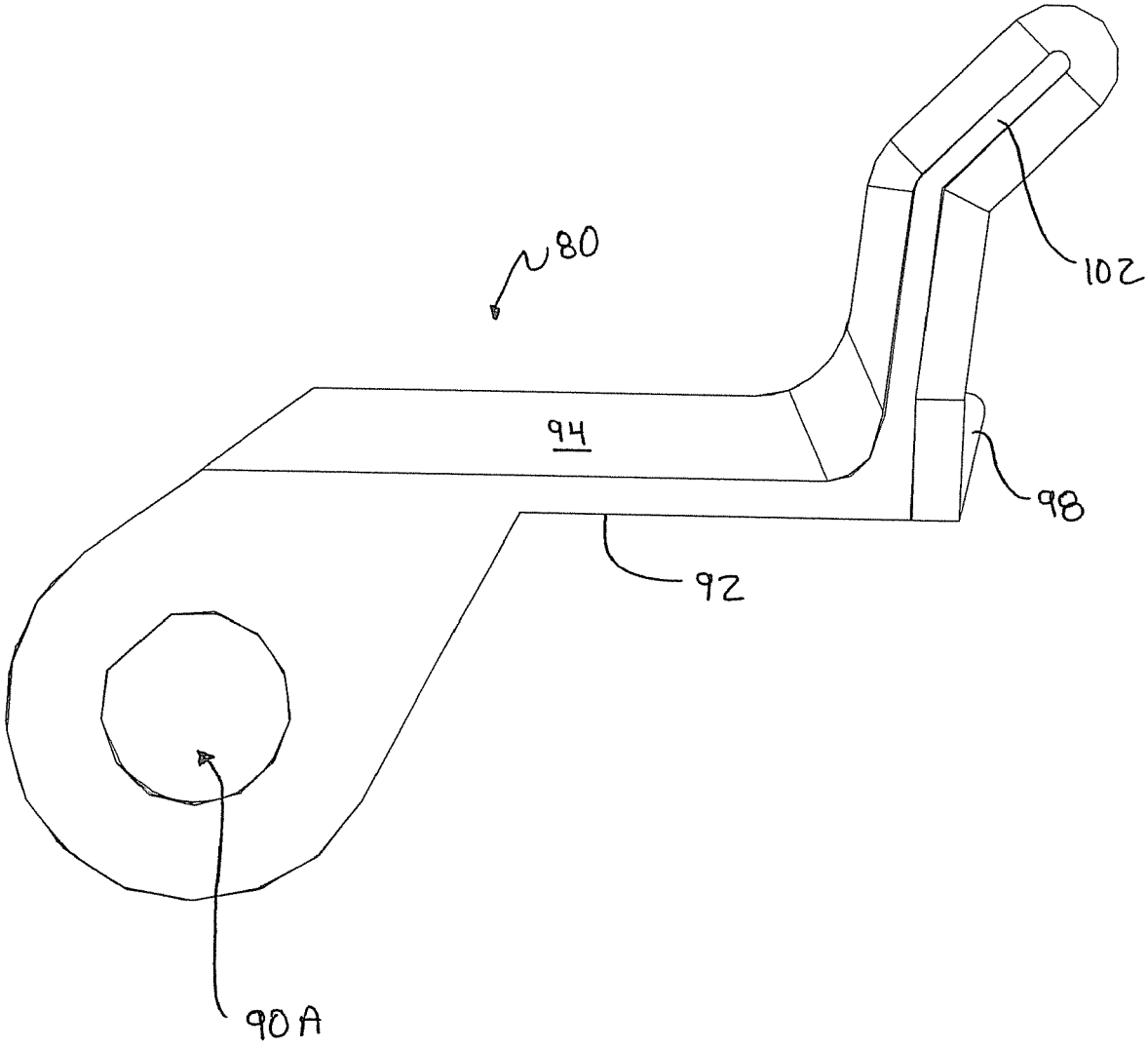

Wire-holding member 42 comprises a probe-access face 70 (shown best in FIGS. 7, 11A and 11E). Probe-access face 70 may extend generally perpendicularly to face 52, although this perpendicular relationship is not necessary. In the illustrated embodiment, probe-access face 70 is penetrated by a pair of apertures 72A, 72B (FIGS. 11A, 11B). When wire-holding member 42 is in its connection configuration, terminals 12A, 12B respectively project into apertures 72A, 72B from one side of probe-access face 70. Preferably, apertures 72A, 72B are dimensioned to be slightly larger (e.g. less than 25% larger) in cross-section than the cross-sectional dimension of terminals 12A, 12B. Having apertures 72A, 72B sized in this manner allows terminals 12A, 12B to project easily into apertures 72A, 72B, but prevents terminals from excessive movement when wire-holding member 42 is in its connection configuration.

In the illustrated embodiment, apertures 72A, 72B respectively intersect with wire-holding conduits 44A, 44B. Preferably the center of the transverse dimension (see arrow 35 of FIGS. 8 and 9) of aperture 72A coincides generally with the center of the transverse dimension of wire-holding conduit 44A and the center of the transverse dimension of aperture 72B coincides generally with the center of the wire-holding conduit 44B.

In the illustrated embodiment, probe-access face 70 also comprises a pair of probe-access channels 74A, 74B which are respectively contiguous with apertures 72A, 72B (see FIGS. 11A, 11E and see corresponding components of wire-connection apparatus 14 in FIG. 9). Probe-access channels 74A, 74B comprise indents in probe-access face 70. When wire-holding member 42 is in its connection configuration, terminals 12A, 12B respectively project through apertures 72A, 72B and into probe-access channels 74A, 74B. In the depicted views, wire-holding member 42 of probe connection apparatus 12 is in its wire insertion/removal configuration. However, wire-holding member 42 of wire-connection apparatus 14 is in its connection configuration. It can be seen by examining wire-connection apparatus 14 in FIG. 9, how terminals 14A, 14B of wire-connection apparatus 14 respectively project through apertures 72A, 72B and into probe access channels 74A, 74B.

In the illustrated embodiment, probe-access channels 74A, 74B extend in the longitudinal direction (see arrow 33 of FIGS. 8 and 9) on both side of apertures 72A, 72B. As discussed in more detail below, this longitudinal extension of probe-access channels 74A, 74B on both sides of apertures 72A, 72B allows terminals 12A, 12B to be easily probed using a pair of alligator clips or similar probe tips. Preferably, as shown in FIG. 11A, the indents of probe-access channels 74A, 74B are separated from one another by a non-conducting divider 76 which extends in the longitudinal direction between probe-access channels 74A, 74B. Divider 76 prevents probe tips inserted into probe-access channels 74A, 74B from accidentally shorting by contacting one another. In the illustrated embodiment, divider 76 is integrally formed with wire-holding member 42, although this integral formation is not necessary.

In the illustrated embodiment, probe-access face 70 of wire-holding member 42 is also penetrated by an aperture 78 (FIGS. 11A, 11B) for facilitating the operation of pivot joint 46 by allowing pin holders 50 to pass therethrough. Aperture 78 may not be required when pivot joint 46 is implemented using other pivot joint mechanisms or where hinge pin 48 is sufficiently far offset from the inside of probe-access face 70.

The operation of wire-holding member 42 to effect electrical contact between wire 16A terminal 12A is now described. Effecting electrical contact between wire 16B and terminal 12B is substantially similar to effecting electrical contact between wire 16A and terminal 12A. First, wire connecting member 42 is pivoted to its wire insertion/removal configuration. An end of wire 16A is then inserted into its corresponding wire-holding conduit 44A. The end of wire 16A is preferably pushed into wire-holding conduit 44A until it extends past the intersection of wire-holding conduit 44A and aperture 72A and into the portion 44A' of wire-holding conduit 44A on the opposing side of aperture 72A (see FIG. 11E). The end of wire 16A may or may not be stripped—i.e. the end of wire 16A may or may not have its insulation removed.

Wire-holding member 42 is then pivoted (at pivot joint 46) to its connection configuration. When wire-holding member 42 is pivoted to its connection configuration, terminal 12A projects through aperture 72A (see the projection of corresponding terminal 14A through aperture 72A in FIG. 9). As wire-holding member 42 pivots toward its connection configuration, wire 16A is received between wire-receiving portions 34A', 34A" of adjacent edges 30A', 30A" of terminal 12A. As wire-holding member 42 continues to pivot toward its connection configuration, wire-receiving portions 34A', 34A" guide wire 16A toward contact portions 32A', 32A" of adjacent edges 30A', 30A", where contact portions 32A', 32A" cut through the insulation of wire 16A (if present) and make electrical contact with the conductive inner core of wire 16A. As discussed above, the transverse spacing (see arrow 35 of FIGS. 8 and 9) between contact portions 32A' 32A" is preferably slightly less than the diameter of the conductive inner core of wire 16A. Consequently, when wire-holding member 42 reaches its connection configuration and wire 16A is located between contact portions 32A', 32A", wire 16A causes a slight resilient deformation of contact portions 32A', 32A" and/or contact portions 32A', 32A" cause a slight deformation of wire 16A. This slight deformation maintains a good electrical contact between wire 16A and terminal 12A. Uncoupling the electrical connection between wire 16A and terminal 12A is the reverse of establishing the electrical connection.

In the illustrated embodiment, wire-connection apparatus 12 comprises a probe-access cover 80 which is pivotally mounted to wire-holding member 42 at pivot joint 82 which allows probe-access cover 80 to pivot relative to wire-holding member 42 and/or electrical component 10 about a pivot axis 82A that extends in the transverse direction (arrow 33 of FIGS. 8 and 9). In the illustrated embodiment, pivot joint 82 comprises a pair of hinge pins 84A, 84B which project transversely from the sides 88A, 88B of wire-holding member 42 and a corresponding pair of pin-receiving members 90A, 90B which extend from an underside 92 of probe-access cover 80. In the illustrated embodiment, pin-receiving members 90A, 90B comprise pin-receiving apertures, but this is not necessary. Pin-receiving members 90A, 90B may comprise indents or the like. Hinge pins 84A, 84B project into pin-receiving members 90A, 90B which extend into the transversely recessed portions 86A, 86B of the sides 88A, 88B of wire-holding member 42 (see FIGS. 11E and 12A). It will be appreciated that pivot joint 82 may be implemented using a wide variety of pivot joint mechanisms and such alternative pivot joint mechanisms should be understood to fall within the scope of the invention.

For ease of reference, in the illustrated embodiment, the various configurations of probe-access cover 80 about pivot joint 82 may be described relative to wire-holding member 42. Probe-access cover 80 may be pivoted about pivot joint 82 to a configuration wherein an underside 92 of cover portion 94 of probe-access cover 80 abuts against wire-holding member 42. This configuration is referred to in this description as the "closed configuration" of probe-access cover 80.

Figure 5:
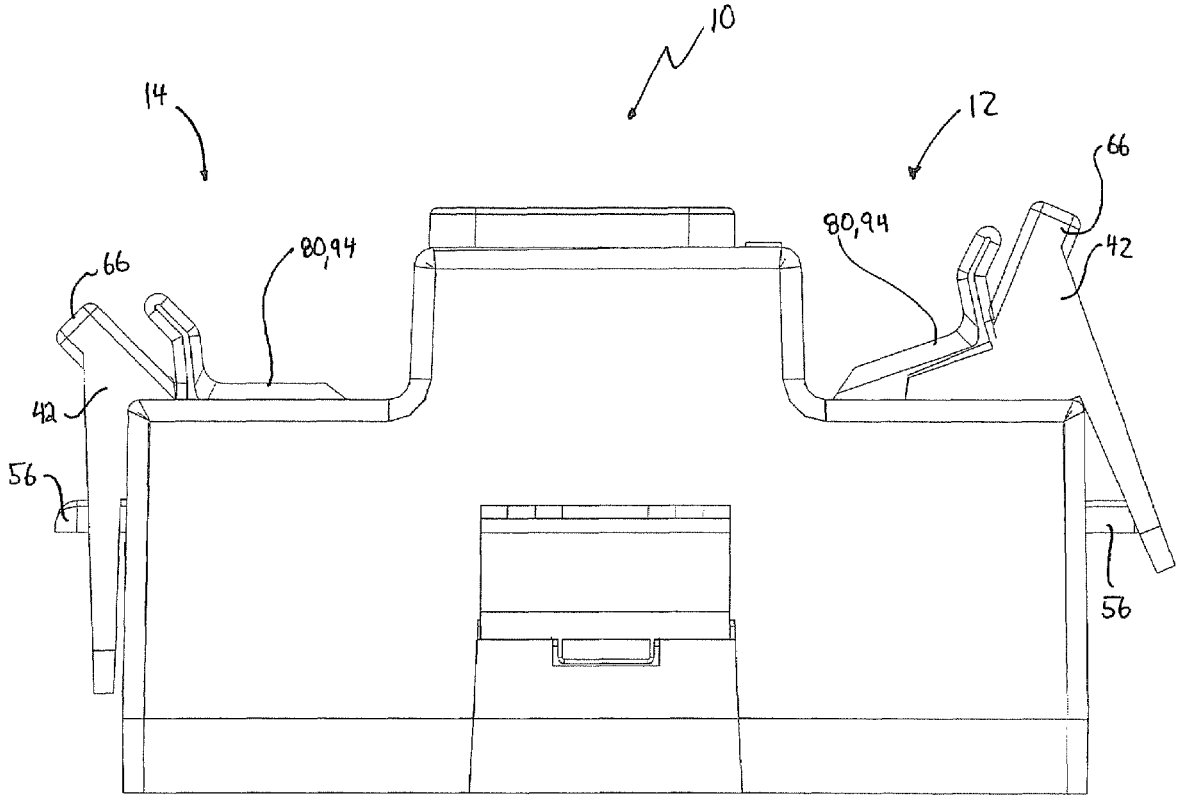
FIG. 5 is a side plan view of the FIG. 1 surge protector.
Figure 6:
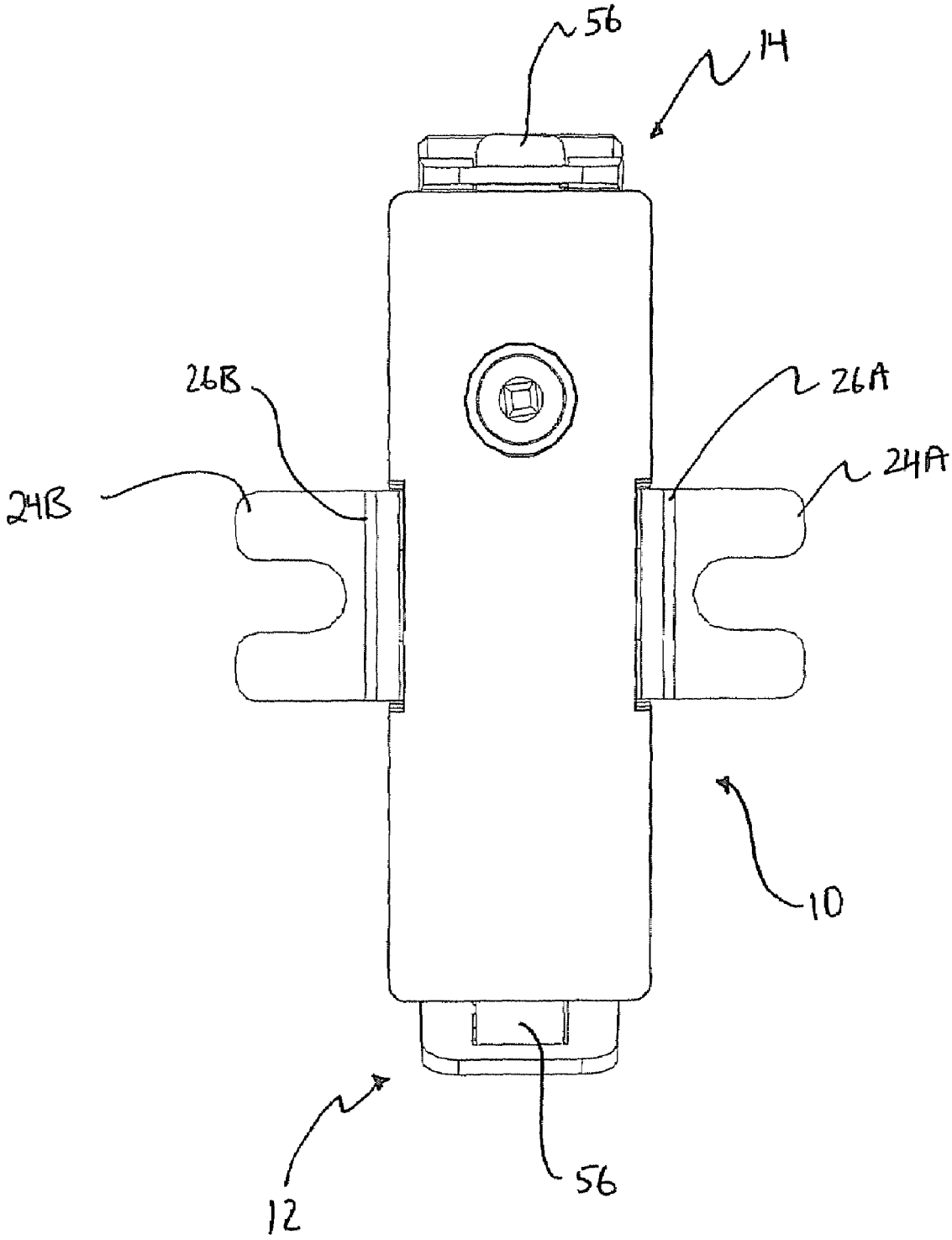
FIG. 6 is a bottom plan view of the FIG. 1 surge protector.

In the illustrated embodiment, probe-access cover 80 is pivotally coupled to wire-holding member 42 which itself is pivotal relative to electrical component 10. Consequently, probe-access cover 80 may be in its closed configuration when wire-holding device 42 is in its connection configuration or when wire-holding device 42 is in its wire insertion/removal configuration. For example, FIGS. 1, 3 and 5 show probe-access cover 80 of wire-connection apparatus 12 in its closed configuration relative to the corresponding wire-holding device 42 of wire-connection apparatus 12, which is in its wire insertion/removal configuration. Similarly, FIGS. 1, 3 and 5 show probe-access cover 80 of wire-connection apparatus 14 in its closed configuration relative to the corresponding wire-holding device 42 of wire-connection apparatus 14, which is in its connection configuration.

When probe-access cover 80 is in its closed configuration, cover portion 94 of probe-access cover 80 covers probe-access channels 74A, 74B. Accordingly, when probe-access cover 80 is in its closed configuration and wire-holding member 42 is in its connection configuration, cover portion 94 of probe-access cover 80 encloses or otherwise covers terminals 12A, 12B to ensure that terminals 12A, 12B are not disturbed. By way of non-limiting example, configuring probe-access cover 80 in its closed configuration prevents terminals 12A, 12B from being accidentally shorted by individuals working a vicinity of electrical component 10.

Wire-connection apparatus 12 may comprise a locking mechanism 96 for locking probe-access cover 80 in its closed configuration. In the illustrated embodiment, locking mechanism 96 is a snap lock mechanism comprising a projection 98 on probe-access cover 80 (FIGS. 12A, 12B) and a corresponding projection 100 on tab 66 of wire-holding member 42 (FIGS. 11A, 11E). Projection 100 of wire-holding member 42 is preferably spaced apart from face 70 of wire-holding member 42 by a dimension approximately equal to a corresponding dimension of projection 98 of probe-access cover 80. Accordingly, when probe-access cover 80 is in its closed configuration, projection 98 extends between face 70 and projection 100, thereby locking probe-access cover 80 in its closed configuration.

Preferably, pivoting probe-access cover 80 such that projection 98 passes from one side of projection 100 to the other side of projection 100 involves deformation of probe-access cover 80 and/or wire-holding member 42. Preferably, the force required to effect this deformation is an amount of force that is relatively easily imparted by a human user when the user is specifically trying to pivot probe-access cover 80, but is greater than an amount of force that might be implemented by random incidental contact or the like. As shown best in FIG. 12B, probe-access cover 80 may comprise a tab 102 that extends at an angle from cover portion 94 to give users a surface to apply such force with their fingers or thumbs.

Figure 13:
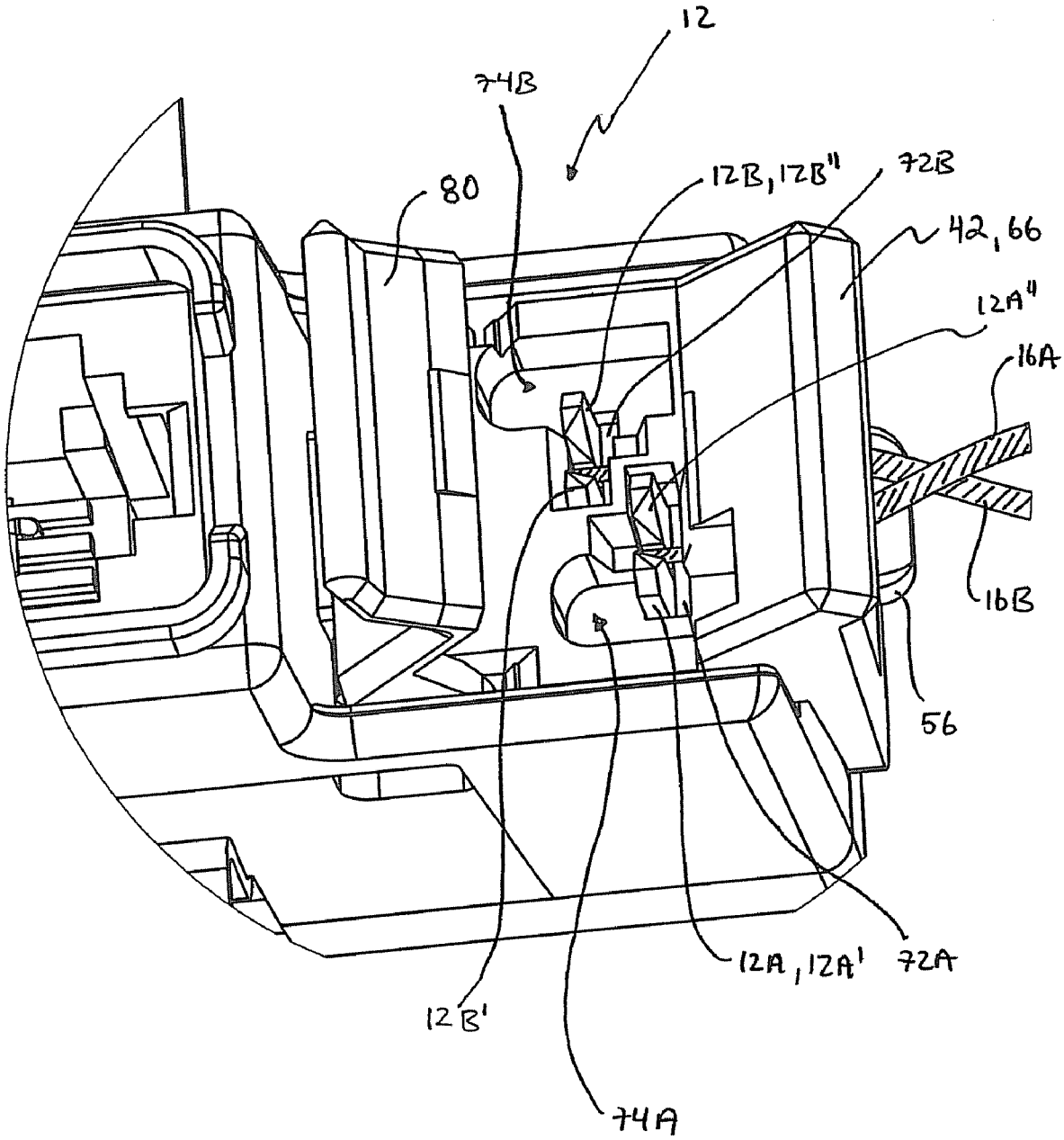
FIG. 13 is a partial isometric view showing one of the wire-holding members and one of the probe-access covers of the FIG. 1 surge protector with the wire-holding member in its connection configuration and the probe-access cover in its open configuration.

Probe-access cover 80 may also be pivoted at pivot joint 82 to a configuration, wherein underside 92 of cover portion 94 of probe-access cover 80 is spaced apart from probe-access face 70 of wire-holding member 42. This angular configuration of probe-access cover 80 relative to wire-holding member 42 is referred to in this description as the "open configuration" of probe-access cover 80. FIGS. 7 and 13 show probe-access cover 80 in its open configuration.

Wire-connection apparatus 12 permits terminal 12A to be probed (e.g. using electrical measurement and/or diagnostic equipment) while wire-holding member 42 is in its connection configuration and electrical contact exists between wire 16A and terminal 12A. More specifically, wire-connection apparatus 12 permits terminal 12A to be probed while wire-holding apparatus 42 is in its connection configuration (i.e. wire 16A is electrically connected to terminal 12A) and probe-access cover 80 is in its open configuration. As discussed above, when wire-holding member 42 is in its connection configuration, terminal 12A projects through aperture 72A and into probe-access channel 74A and when probe-access cover 80 is in its open configuration relative to wire-holding member 42, cover portion 94 of probe-access cover 80 is spaced apart from probe-access face 70 of wire-holding member 42. As such, the probes of electrical measurement and/or diagnostic equipment may be inserted under probe-access cover 80 and into probe-access channel 74A to contact terminal 12A and thereby detect information about the electrical signals on terminal 12A and/or wire 16A.

Advantageously, probe-access channel 74A extends longitudinally (arrow 33 of FIGS. 8 and 9) on both sides of terminal 12A (see FIG. 13 and the corresponding probe-access channel 74A of terminal 14A in FIG. 9). This longitudinal extension of probe-access channel 74A on both sides of terminal 12A allows users to probe terminal 12A with "alligator clip" type probes which squeeze terminal 12A between the clip faces.

It will be appreciated that terminal 12B (and wire 16B) can be probed in a similar manner when wire-holding apparatus 42 is in its connection configuration and probe-access cover 80 is in its open configuration. Similarly, terminals 14A, 14B of wire-connection apparatus 14 (and wires 18A, 18B) can be probed when the wire-holding apparatus 42 of wire-connection apparatus 14 is in its wire-connection configuration and the probe-access cover 80 of wire-connection apparatus 14 is in its open configuration.

As will be apparent to those skilled in the art in the light of the foregoing disclosure, many alterations and modifications are possible in the practice of this invention without departing from the spirit or scope thereof. For example:

In the illustrated embodiment, locking mechanism 62 comprises a protrusion 64 from one edge 58B of aperture 54. In other embodiments, locking mechanism 64 may comprises a pair of protrusions from edges 58A, 58B of aperture 54.

In the illustrated embodiment, wire-connection apparatus 12 comprises a locking mechanism 62 for locking wire-holding member 42 in its connection configuration. In other embodiments, wire-connection apparatus may comprise a locking mechanism for locking wire-holding member 42 in its wire insertion/removal configuration. Such a locking mechanism may comprise a snap lock mechanism and may be implemented using one or more protrusions similar to protrusion 64.

In the above described embodiment, probe-access cover 80 is pivotally mounted at pivot joint 82 to wire-holding member 42. In other embodiments, probe-access cover 80 is pivotally mounted directly to electrical component 10. In still other embodiments, probe-access cover 80 is moveable relative to wire-holding member 42 and/or relative to electrical component 10 by means other than a pivot joint. By way of non-limiting example, probe-access cover 80 may be translatably movable relative to wire-holding member 42 and/or relative to electrical component 10.

In the illustrated embodiment, each wire-connection apparatus 12, 14 comprises a pair of separate terminals for respectively connecting to a pair of wires. In other embodiments, wire-connection apparatus 12, 14 may be provided with different numbers of terminals for connecting to different numbers of wires.

Accordingly, it is intended that the invention be interpreted in accordance with the following claims.

What is claimed is:

1. An electrical apparatus comprising:

an electrical component having a terminal comprising a pair of contact members having a pair of adjacent edges;

a wire-holding member comprising a wire-holding conduit and a passage intersecting the wire-holding conduit, the wire-holding member pivotal to a connection configuration wherein the terminal is received in the passage and a wire received in the wire holding conduit extends through a space between the adjacent edges of the contact members to make electrical contact with the terminal;

a probe-access cover pivotally connected to the wire-holding member about a pivot joint formed between the probe-access cover and the wire-holding member for pivotal movement with respect to the wire-holding member between:

a closed configuration, wherein the probe-access cover protects the terminal from contact; and an open configuration, wherein the probe-access cover is spaced apart from the terminal for exposing at least a portion of the terminal to contact by an electrical probe.

2. An apparatus according to claim 1 wherein, when the probe-access cover is in the closed configuration and the wire-holding member is in the connection configuration, a cover portion of the probe-access cover extends along a face of the wire holding member in contact with at least a portion thereof.

3. An apparatus according to claim 1 wherein, when the probe-access cover is in the open configuration and the wire-holding member is in the connection configuration, the cover portion is spaced apart from the face.

4. An apparatus according to claim 3 wherein, when the wire-holding member is in the connection configuration, at least a portion of the terminal projects into a probe-access channel, the probe-access channel comprising a recessed region in the face.

5. An apparatus according to claim 1 wherein the wire-holding member is pivotal to a second configuration wherein the wire is electrically disconnected from the terminal.

6. An apparatus according to claim 1 wherein:

the electrical component comprises a plurality of terminals, each terminal comprising a corresponding pair of contact members having a corresponding pair of adjacent edges;

the wire-holding member comprises a plurality of wire-holding conduits and a plurality of passages, each passage intersecting a corresponding one of the wire-holding conduits and wherein, when the wire-holding member is pivoted to its connection configuration, a corresponding one of the terminals is received in each of the passages and, for each passage, a wire received in the corresponding one of the wire-holding conduits makes electrical contact with the corresponding one of the terminals;

when the probe-access cover is in its closed configuration and the wire-holding member is in its connection configuration, the probe-access cover protects the plurality of terminals from contact; and when the probe-access cover is in its open configuration and the wire-holding member is in its connection configuration, the probe-access cover is spaced apart from the terminals for exposing at least a portion of each of the terminals to contact by electrical probes.

7. An apparatus according to claim 6 wherein, when the probe-access cover is in the closed configuration and the wire-holding member is in the connection configuration, a cover portion of the probe-access cover extends along a face of the wire holding member in contact with at least a portion thereof.

8. An apparatus according to claim 6 wherein the electrical component is a surge protector.

9. An apparatus according to claim 7 wherein, when the wire-holding member is in the connection configuration, at least a portion of each of the terminals projects into a corresponding probe-access channel, each probe-access channel comprising a recessed region in the face.

10. An electrical apparatus comprising:

an electrical component having a terminal comprising a pair of contact members having a pair of adjacent edges;

a wire-holding member comprising a wire-holding conduit and a passage intersecting the wire-holding conduit, the wire-holding member pivotal to a connection configuration wherein the terminal is received in the passage and a wire received in the wire holding conduit extends through a space between the adjacent edges of the contact members to make electrical contact with the terminal;

a probe-access cover movably connected for movement with respect to the wire-holding member to:

a closed configuration, wherein the probe-access cover protects the terminal from contact; and an open configuration, wherein the probe-access cover is spaced apart from the terminal for exposing at least a portion of the terminal to contact by an electrical probe;

wherein, when the probe-access cover is in the open configuration and the wire-holding member is in the connection configuration, the cover portion is spaced apart from the face;

wherein, when the wire-holding member is in the connection configuration, at least a portion of the terminal projects into a probe-access channel, the probe-access channel comprising a recessed region in the face; and wherein, when the wire-holding member is in the connection configuration, the probe access channel extends on both sides of the terminal in a longitudinal direction generally parallel with the wire-holding conduit.

11. An apparatus according to claim 10 wherein, when the wire-holding member is in the connection configuration, the probe access channel extends generally equidistantly on both of the sides of the terminal.

12. An apparatus according to claim 10 wherein the probe-access channel is offset from the terminal in a transverse direction generally orthogonal to the longitudinal direction.

13. An apparatus according to claim 12 wherein the transverse-direction offset between the terminal and the wire-holding member is such that when the wire-holding member is in the connection configuration, only one of the pair of contact members of the terminal projects into the probe-access channel.

14. An apparatus according to claim 10 wherein the wire-holding member is pivotal to a second configuration wherein the wire is electrically disconnected from the terminal.

15. An apparatus according to claim 14 wherein the probe-access cover is pivotal relative to the wire-holding member about a first pivot joint formed between the probe-access cover and the wire-holding member.

16. An apparatus according to claim 15 comprising a first locking mechanism for constraining pivotal motion of the first pivot joint when the probe-access cover is in its closed configuration.

17. An apparatus according to claim 16 wherein the wire-holding member is pivotal relative to the electrical component about a second pivot joint formed between the wire-holding member and the electrical component.

18. An apparatus according to claim 17 wherein one of the wire-holding member and the electrical component comprises an aperture and the other one of the wire-holding member and the electrical component comprises a projection which projects into the aperture and together the projection and aperture provide a stop for pivotal motion of the second pivot joint when the wire-holding member is in the second configuration and the projection contacts a first edge of the aperture.

19. An apparatus according to claim 14 wherein the probe-access cover can be maintained in the closed configuration when the wire-holding member is in the connection configuration and when the wire-holding member is in the second configuration.

20. An electrical apparatus comprising:

an electrical component having a terminal comprising a pair of contact members having a pair of adjacent edges;

a wire-holding member comprising a wire-holding conduit and a passage intersecting the wire-holding conduit, the wire-holding member pivotal to a connection configuration wherein the terminal is received in the passage and a wire received in the wire holding conduit extends through a space between the adjacent edges of the contact members to make electrical contact with the terminal;

a probe-access cover movably connected for movement with respect to the wire-holding member to:

a closed configuration, wherein the probe-access cover protects the terminal from contact; and an open configuration, wherein the probe-access cover is spaced apart from the terminal for exposing at least a portion of the terminal to contact by an electrical probe;

wherein the wire-holding member is pivotal to a second configuration wherein the wire is electrically disconnected from the terminal; and wherein the probe-access cover is pivotal relative to the wire-holding member about a first pivot joint formed between the probe-access cover and the wire-holding member.

21. An apparatus according to claim 20 wherein the first pivot joint comprises a pair of hinge pins extending in transverse directions generally orthogonal to the wire-holding conduit and a corresponding pair of spaced apart pin-receiving members for receiving the hinge pins therein, the pin holders deformable for inserting the hinge pins and for removing the hinge pins therefrom, wherein each of the pins and the pin holders are located on a corresponding one of: the probe-access cover and the wire-holding member.

22. An apparatus according to claim 20 comprising a first locking mechanism for constraining pivotal motion of the first pivot joint when the probe-access cover is in its closed configuration.

23. An apparatus according to claim 22 wherein engaging and disengaging the first locking mechanism involve deformation of one or more of: the wire-holding member and the probe-access cover.

24. An apparatus according to claim 22 wherein the first locking mechanism comprises a projection on the probe-access cover which engages a corresponding projection on the wire-holding member when the probe-access cover is in its closed configuration.

25. An apparatus according to claim 20 wherein the wire-holding member is pivotal relative to the electrical component about a second pivot joint formed between the wire-holding member and the electrical component.

26. An apparatus according to claim 25 wherein the second pivot joint comprises a hinge pin extending in a transverse direction generally perpendicular to the wire-holding conduit and corresponding pair of spaced apart pin holders for receiving the hinge pin therebetween, the pin holders deformable for inserting and removing the hinge pin from therebetween, wherein each of the hinge pin and the pin holders are located on a corresponding one of: the wire-holding member and the electrical component.

27. An apparatus according to claim 25 wherein one of the wire-holding member and the electrical component comprises an aperture and the other one of the wire-holding member and the electrical component comprises a projection which projects into the aperture and together the projection and aperture provide a stop for pivotal motion of the second pivot joint when the wire-holding member is in the second configuration and the projection contacts a first edge of the aperture.

28. An apparatus according to claim 27 comprising a second locking mechanism for constraining pivotal motion of the second pivot joint when the wire-holding member in the connection configuration.

29. An apparatus according to claim 28 wherein the second locking mechanism comprises a protrusion extending into the aperture from a second edge thereof, the aperture narrower than the projection in a region of the protrusion.

30. An apparatus according to claim 29 wherein the projection is moveable within the aperture from one side of the region of the protrusion to the opposing side of the region of the protrusion to thereby engage or disengage the second locking mechanism and such movement involves deformation of at least one of: the wire-holding member and the electrical component.

31. An electrical apparatus comprising:

an electrical component having a terminal comprising a pair of contact members having a pair of adjacent edges;

a wire-holding member comprising a wire-holding conduit and a passage intersecting the wire-holding conduit, the wire-holding member pivotal to a connection configuration wherein the terminal is received in the passage and a wire received in the wire holding conduit extends through a space between the adjacent edges of the contact members to make electrical contact with the terminal;

a probe-access cover movably connected for movement with respect to the wire-holding member to:

a closed configuration, wherein the probe-access cover protects the terminal from contact; and an open configuration, wherein the probe-access cover is spaced apart from the terminal for exposing at least a portion of the terminal to contact by an electrical probe;

wherein:

the electrical component comprises a plurality of terminals, each terminal comprising a corresponding pair of contact members having a corresponding pair of adjacent edges;

the wire-holding member comprises a plurality of wire-holding conduits and a plurality of passages, each passage intersecting a corresponding one of the wire-holding conduits and wherein, when the wire-holding member is pivoted to its connection configuration, a corresponding one of the terminals is received in each of the passages and, for each passage, a wire received in the corresponding one of the wire-holding conduits makes electrical contact with the corresponding one of the terminals;

when the probe-access cover is in its closed configuration and the wire-holding member is in its connection configuration, the probe-access cover protects the plurality of terminals from contact; and when the probe-access cover is in its open configuration and the wire-holding member is in its connection configuration, the probe-access cover is spaced apart from the terminals for exposing at least a portion of each of the terminals to contact by electrical probes;

wherein, when the probe-access cover is in the closed configuration and the wire-holding member is in the connection configuration, a cover portion of the probe-access cover extends along a face of the wire holding member in contact with at least a portion thereof;

wherein, when the wire-holding member is in the connection configuration, at least a portion of each of the terminals projects into a corresponding probe-access channel, each probe-access channel comprising a recessed region in the face; and wherein, when the wire-holding member is in the connection configuration, each probe access channel extends on both sides of the corresponding terminal in a direction generally parallel with the corresponding wire-holding conduit.

32. An electrical apparatus comprising:

an electrical component having a terminal comprising a pair of contact members having a pair of adjacent edges;

a wire-holding member connected for pivotal motion with respect to the terminal, the wire-holding member penetrated by a wire-holding conduit for receiving a corresponding wire and pivotal to a connection configuration wherein the corresponding wire extends through a space between the adjacent edges of the contact members to make electrical contact with the terminal;

a probe-access cover connected for pivotal motion with respect to the wire-holding member, the probe-access cover pivotal to:

a closed configuration, such that when the probe-access cover is in its closed configuration and the wire-holding member is in its connection configuration, a cover portion of the probe-access cover extends along a face of the wire-holding member for protecting the terminal from contact; and an open configuration, such that when the probe-access cover is in its open configuration and the wire-holding member is in its connection configuration, the cover portion is spaced apart from the face for exposing at least a portion of the terminal to contact by an electrical probe.

33. An apparatus according to claim 32 wherein the probe-access cover is connected for pivotal motion with respect to the wire-holding member about a pivot joint formed between the probe-access cover and the wire-holding member, the pivot joint comprising at least one hinge pin protrusion located on one of the probe-access cover and the wire-holding member, the at least one hinge pin protrusion rotatable within a corresponding hinge receptacle located on the other one of the probe-access over and the wire-holding member to facilitate pivotal motion of the probe-access cover with respect to the wire-holding member.

34. An electrical apparatus comprising:

an electrical component having a terminal comprising a pair of contact members having a pair of adjacent edges;

a wire-holding member comprising a wire-holding conduit and a passage intersecting the wire-holding conduit, the wire-holding member pivotal to a connection configuration wherein the terminal is received in the passage and a wire received in the wire holding conduit extends through a space between the adjacent edges of the contact members to make electrical contact with the terminal;

means for protecting the terminal from contact when the wire-holding member is in the connection configuration; and means for facilitating contact between an electrical probe and the terminal when the wire-holding member is in the connection configuration.

35. An apparatus according to claim 34 wherein the facilitating means comprises a means for moving the protecting means to facilitate contact between the electrical probe and the terminal when the wire-holding member is in the connection configuration.

36. An apparatus according to claim 1 wherein the pivot joint comprises at least one hinge pin protrusion located on one of the probe-access cover and the wire-holding member, the at least one hinge pin protrusion rotatable within a corresponding hinge receptacle located on the other one of the probe-access cover and the wire-holding member to facilitate pivotal movement of the probe-access cover with respect to the wire-holding member.

* * * * *